US007822215B2

(12) United States Patent
Carazo et al.

(10) Patent No.: US 7,822,215 B2
(45) Date of Patent: Oct. 26, 2010

(54) BONE-CONDUCTION HEARING-AID TRANSDUCER HAVING IMPROVED FREQUENCY RESPONSE

(75) Inventors: Alfredo Vazquez Carazo, Norfolk, VA (US); Aayush Malla, North Richland Hills, TX (US)

(73) Assignee: Face International Corp, Norfolk, VA (US)

( * ) Notice: Subject to any disclaimer, the term of this patent is extended or adjusted under 35 U.S.C. 154(b) by 912 days.

(21) Appl. No.: 11/482,346

(22) Filed: Jul. 7, 2006

(65) Prior Publication Data

US 2007/0041595 A1 Feb. 22, 2007

Related U.S. Application Data

(60) Provisional application No. 60/697,510, filed on Jul. 7, 2005.

(51) Int. Cl.
*H04R 25/00* (2006.01)

(52) U.S. Cl. ..... 381/151; 381/326; 381/380; 381/190

(58) Field of Classification Search ..... 381/151, 381/322, 326, 173, 380, 190, 409; 29/25.35, 29/896.21; 310/311, 330; 600/25; 607/56, 607/57

See application file for complete search history.

(56) References Cited

U.S. PATENT DOCUMENTS 2,459,325 A * 1/1949 Knowles ..... 381/151
2,482,044 A * 9/1949 Vernier ..... 381/151
4,591,668 A * 5/1986 Iwata ..... 381/151
5,471,721 A * 12/1995 Haertling ..... 29/25.35
5,632,841 A * 5/1997 Hellbaum et al. ..... 156/245

* cited by examiner

*Primary Examiner*—Huyen D Le
(74) *Attorney, Agent, or Firm*—David J Bolduc

(57) ABSTRACT

A hearing-aid device and a method for transmitting sound through bone conduction are disclosed. The hearing-aid device comprises a piezoelectric-type actuator, housing and connector. The piezoelectric actuator is preferably a circular flextensional-type actuator mounted along its peripheral edge in a specifically designed circular structure of the housing. During operation, the bone-conduction transducer is placed against the mastoid area behind the ear of the patient. When the device is energized with an alternating electrical voltage, it flexes back and forth like a circular membrane sustained along its periphery and thus, vibrates as a consequence of the inverse piezoelectric effect. Due to the specific and unique designs proposed, these vibrations are directly transferred through the human skin to the bone structure (the skull) and provide a means for the sound to be transmitted for patients with hearing malfunctions. The housing acts as a holder for the actuators, as a pre-stress application platform, and as a mass which tailors the frequency spectrum of the device. The apparatus exhibits a performance with a very flat response in the frequency spectrum 200 Hz to 10 kHz, which is a greater spectrum range than any other prior art devices disclosed for bone-conduction transduction which are typically limited to less than 4 kHz.

1 Claim, 9 Drawing Sheets

STATE OF THE ART

STATE OF THE ART

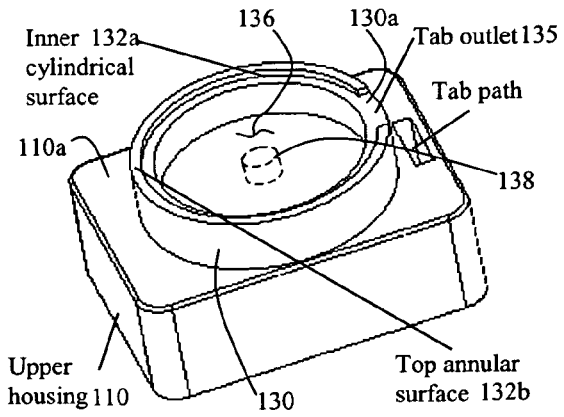
FIG. 8a
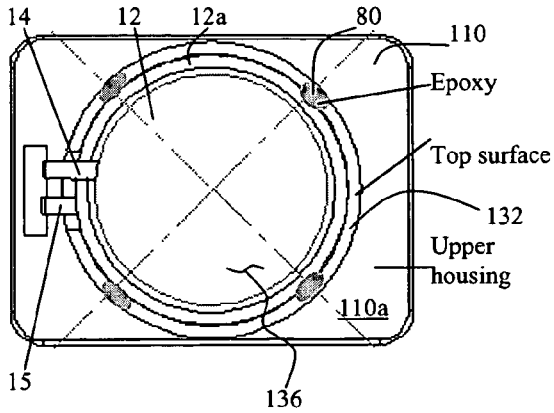
FIG. 8b
FIG. 9
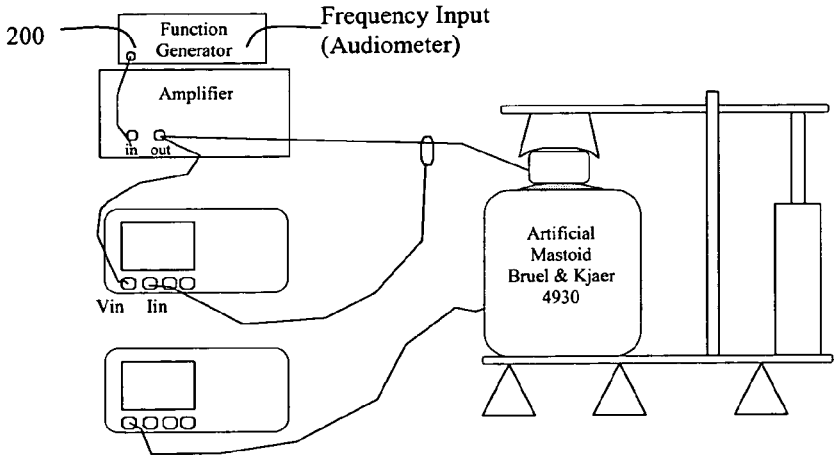
FIG. 10
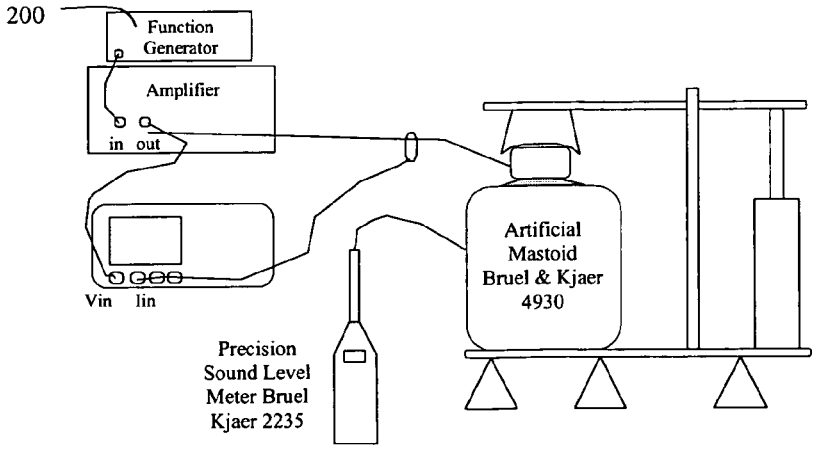

FIG. 11a
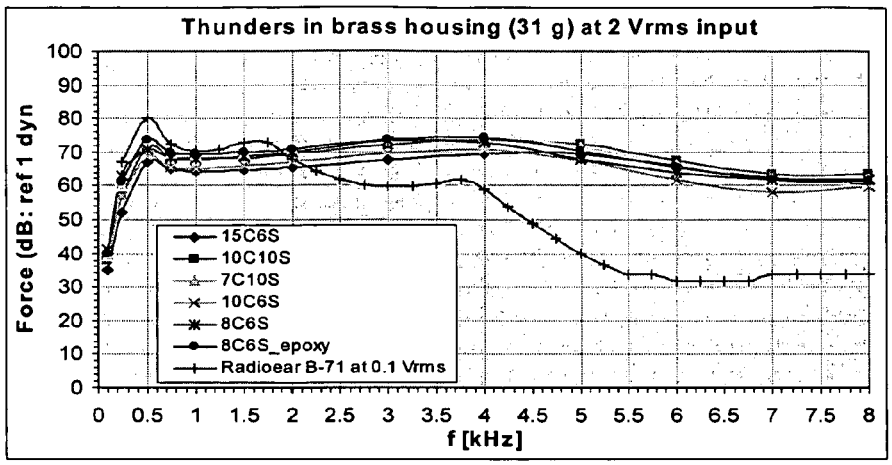
FIG. 11b
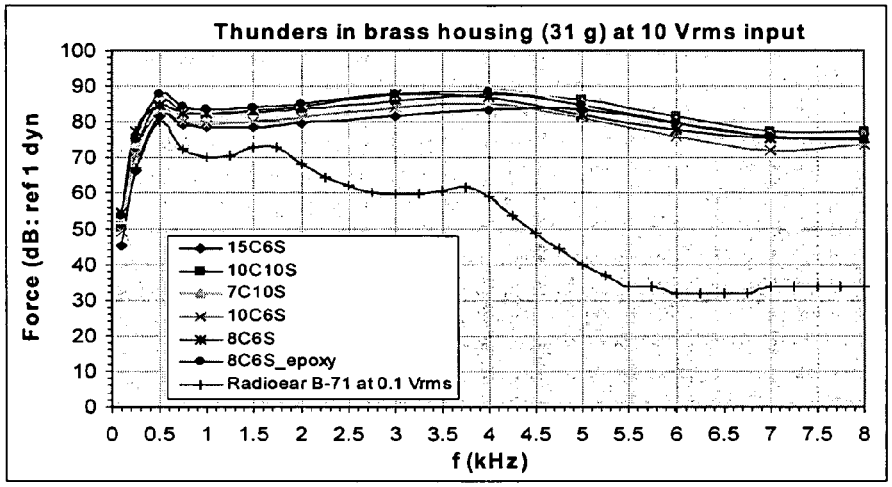
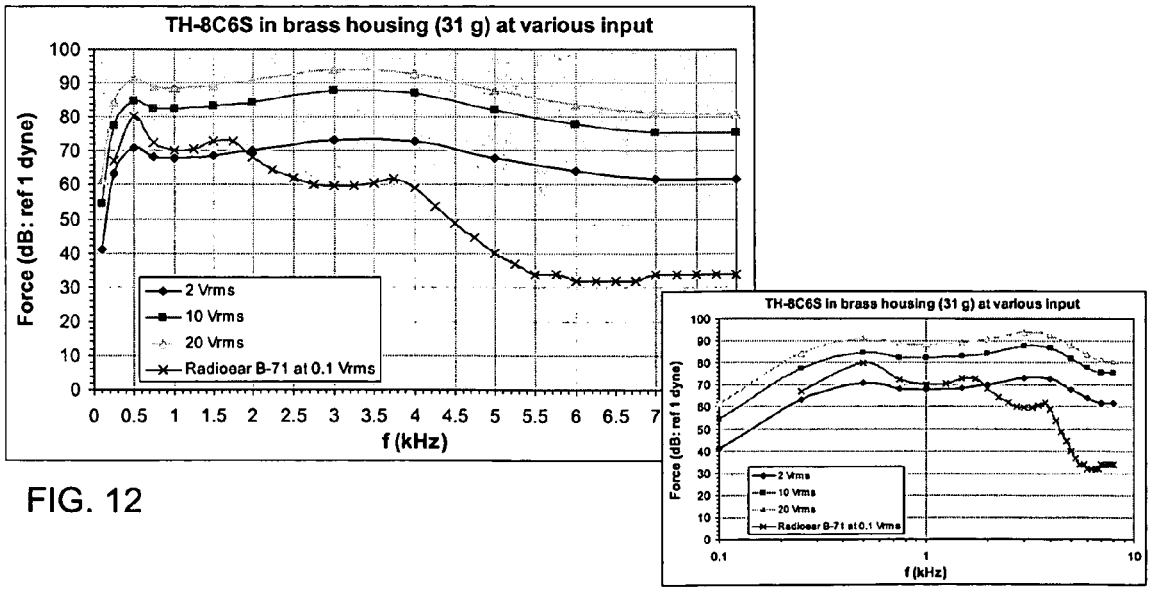
FIG. 12

FIG. 13a
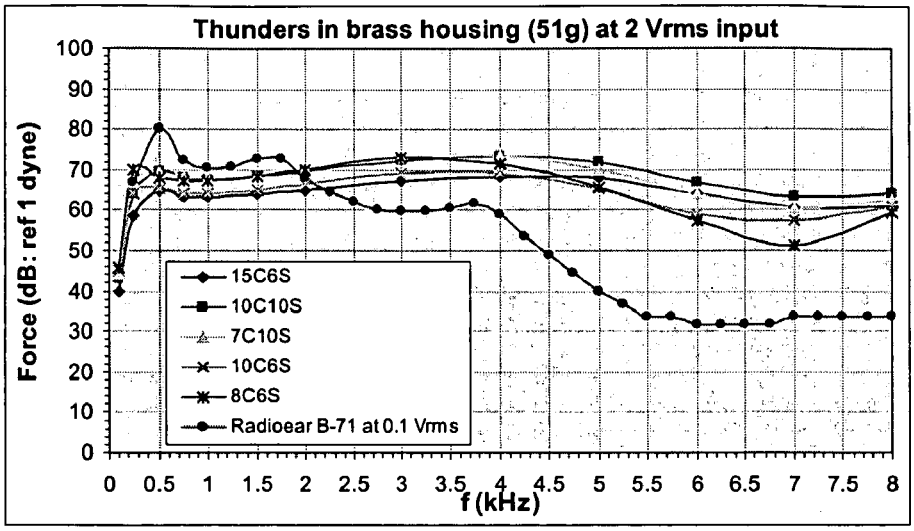
FIG. 13b
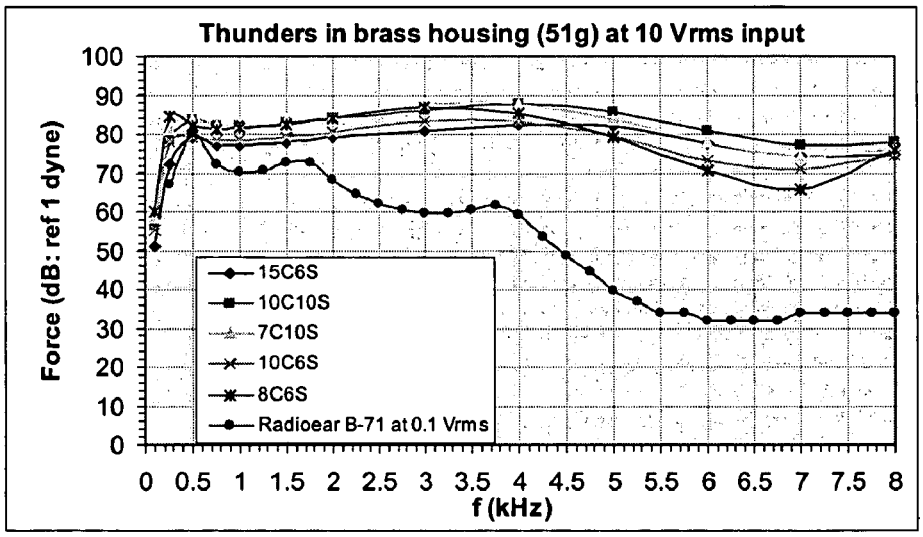
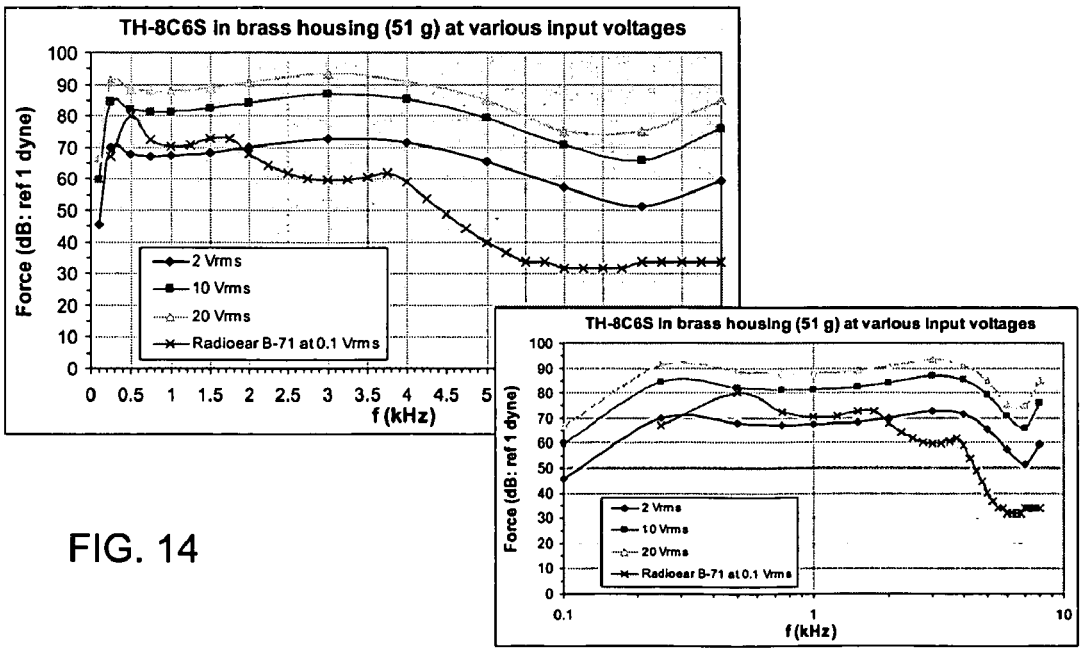
FIG. 14

FIG. 15a
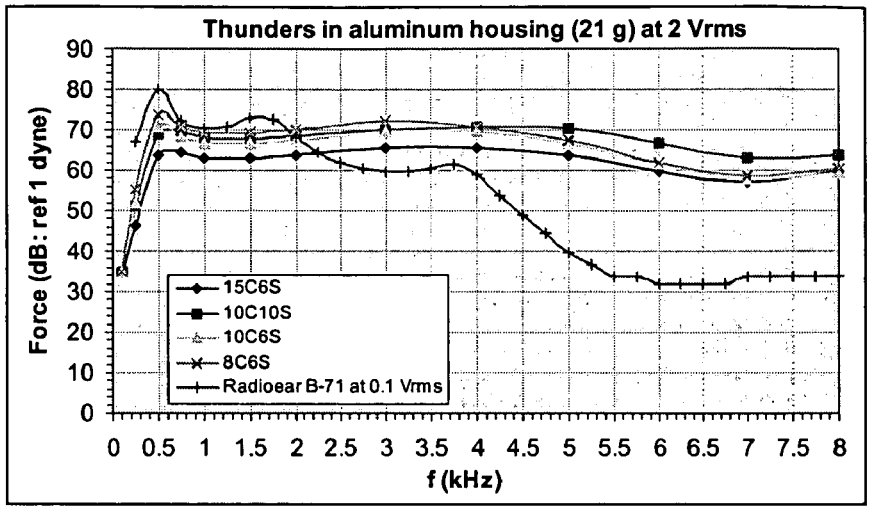
FIG. 15b
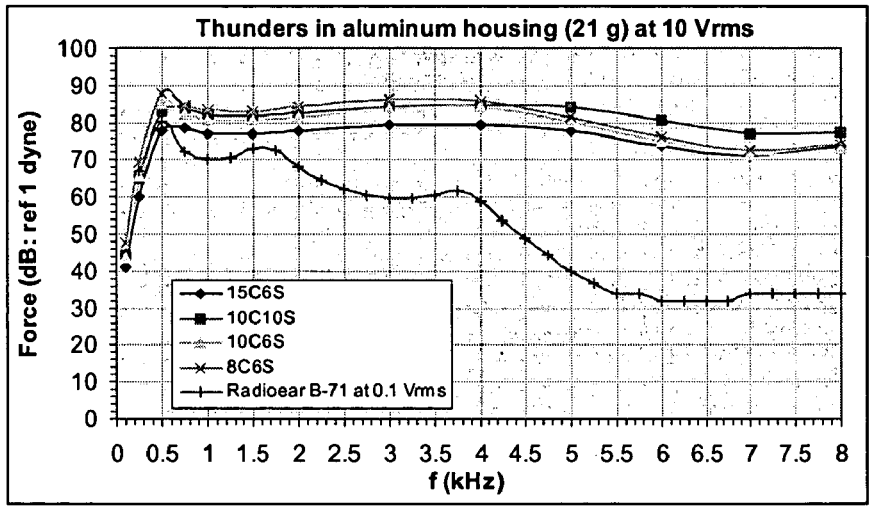
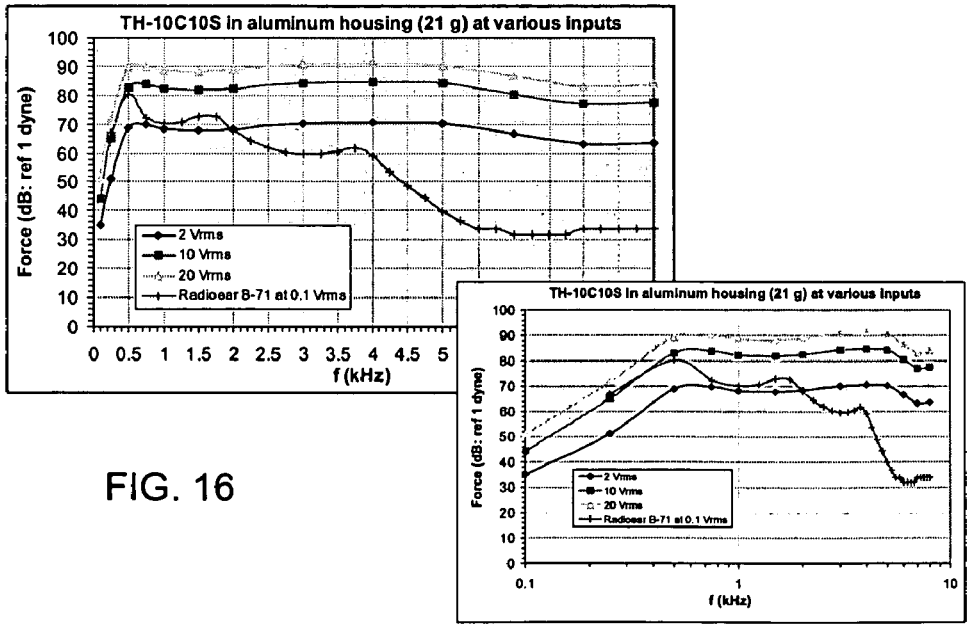
FIG. 16

BONE-CONDUCTION HEARING-AID TRANSDUCER HAVING IMPROVED FREQUENCY RESPONSE

This application claims the benefit of priority under 35 U.S.C. 119(e) from U.S. Provisional Application 60/697,510 filed on Jul. 7, 2005.

BACKGROUND OF THE INVENTION

1. Field of the Invention

The present invention relates to the field of devices and methods for assisting in the perception of sound for the hearing impaired and more specifically to a transducer type for listening to sounds by an abutment to the head for the transmission of transducer vibration to the skull structure. More particularly, the present invention relates to a bone conduction hearing aid having the vibrator element directly in contact with the skin surface of the patient's head.

2. Description of the Prior Art

The human auditory system, consisting of the ears and associated brain structures, possesses remarkable signal processing capabilities. We hear sounds from those that are barely detectable to those that reach the threshold of pain—a difference of about 130 decibels or a ratio of about 10 trillion to one. In addition, the auditory system is a powerful sound analyzer. Rapid changes in the frequency and amplitude of sounds over time, such as those in human speech, are readily detected and decoded. Indeed, human communication is made possible not only because of our special ability to produce speech, but also because of our capabilities in auditory signal processing.

The perception of sound is achieved in human beings through the ear. Sound is transmitted to the ear through vibrations in the air which is known as air conduction. However, it can also be transmitted through the human bone structure (the skull). A very instant example is the ability of a person to perceive the sound from his chewing even when the ears are blocked. This form of sound transmission is termed as "bone conduction".

In normal hearing, sound passes along our ear canals to the eardrum causing the surface of the eardrum to vibrate. These vibrations are passed to the ossicles by a process called air conduction. In turn, these vibrations pass acoustic energy across the oval window and innervate the movement of the cochlear fluids. Movement in this fluid bends the hair cells along the length of the cochlea, generating signals in the auditory nerve. These signals are then transferred to the brain, thus the interpretation of sound.

Like most natural processes of the body, the ability to hear is made possible by an intricate process involving many steps. The mechanical portion of this intricate process takes place in the outer ear, middle ear, and the inner ear. The outer ear, the auricle, collects sound waves and leads these waves into the middle ear. The middle ear couples the sound waves in the air-filled ear canal to fluid of the inner-ear (perilymph). The middle ear, containing the eardrum (tympanic membrane) and three tiny bones (malleus, incus and stapes), is an interface between the low impedance of air and high impedance of inner ear fluid. Pressure induced vibrations of the tympanic membrane ultimately induce a proportional motion of the stapes, the smallest of the three auditory ossicles in the middle ear. This motion is the output of the middle-ear. The stapes transmits this motion to the inner ear. In the inner ear, this motion produces a large pressure in the scala vestibule, a perilymphatic channel on one side of the cochlear duct, in comparison with the scala tympani, a perilymphatic channel on the other side of the cochlear duct separated from the tympanic cavity by the round window membrane. The pressure difference between the two scalae in turn causes a traveling wave to move apically on the basilar membrane. The motion of the basilar membrane causes the cilium of receptor cells, also known as the inner hair cells (IHC) to move, which in turn causes firing of the auditory nerve. This process produces the sensation of hearing.

The ability to hear and the sensitivity at which one is able to hear is diminished by two basic types of ear pathologies that are commonly referred to as i) conductive hearing loss, and ii) sensory-neural hearing loss. Conductive hearing loss may be traced to either a pathological condition of the middle ear or the middle-ear cavity, or impairment (i.e., blockage) of canal or the outer ear. This type of hearing loss is routinely repaired by otology surgeons. On the other hand sensory-neural hearing loss is due to a pathological condition of the inner ear and is nearly impossible to repair via surgery. Just in the United States, it is estimated that over 26 million people suffer from some type of hearing loss problems.

Loss of auditory function is commonly associated with reduced power to detect and decode speech. Persons who experience significant hearing loss are likely to become isolated from normal verbal exchanges. They then lose out on nuances of speech that are vital to that most important and distinctive human trait—communication. As a result, additional problems can develop as a result of misunderstandings and incomplete receipt of information experienced by the person with hearing loss.

Assessment of hearing loss is normally conducted by testing for minimum sound amplitude levels that can be detected. There are two forms of tests used for the basic evaluation of auditory function. The first, air-conduction testing, involves presenting precisely calibrated sounds to the ears, usually by routing the signals through headphones to the external ear canal. The second, bone-conduction testing, sends precisely calibrated signals through the bones of the skull to the inner ear system. Stimulation is received at the skull by placing a transducer either on the mastoid region behind the ear to be tested or through transducer placement on the forehead.

Differences between hearing loss profiles for air and bone conduction can indicate a probable locus for a hearing problem. For example, if air-conduction scores are poorer than bone-conduction scores the indication is that a flaw is present in the mechanisms that carry sound from the eardrum to the inner ear. Remediation of this type of problem might involve surgical repair of damaged conductive elements. If bone-conduction and air-conduction scores show similar levels of hearing loss, then it is likely that there is a deficiency in sensory-neural function. This variety of hearing loss can result from illness, sustained exposure to loud sounds, drug effects or an ageing hearing system. Frequently, with sensory-neural losses it is possible to improve a person's hearing with modern digital hearing instruments.

People with hearing problems also have to resort to hearing aids that are principally used external to the ear. Conventional hearing aids make sounds louder and deliver the acoustic energy to the ear canal via an ear-mold. The ear-mold fits snuggly in the aperture of the ear canal, thus creating a hermetic seal, which only permits sound coming out of the aid to enter the ear. These amplified sounds are then heard through the ear canal via normal air conduction. Sometimes amplification through air conduction does not provide enough amplification to innervate the cochlear fluids. In cases like these where air conduction does not serve the purpose, amplification via bone conduction is the next option.

Hearing by bone conduction as a phenomenon, i.e., hearing sensitivity to vibrations induced directly or via skin or teeth to the skull bone, has been known since the $19^{th}$ century. The interest in bone conduction was initially based on its usefulness as a diagnostic tool. In particular, it is used in hearing threshold testing to determine the sensory-neural hearing loss or, indirectly, to determine the degree of conduction hearing loss by noting the difference between the air and the bone thresholds.

The first electronic bone conduction device was built in 1923 but it was too bulky for any practical purpose. In the past two decades, significant improvements have been made in the development of bone oscillators. With proper power supply instrumentation, these Bone Oscillators permit transduction of low and mid range frequencies.

In the hearing threshold testing field, which is one of the relevant application areas of interest of this patent, one of the most commonly used bone conduction transducers is the Radio Ear B-71 type, which is introduced here as a part of the relevant prior state of the art. The B-71 transducer is an electromagnetic-type transducer of the variable reluctance type. Variable reluctance type transducers function according to the horseshoe magnet principle where there is a small air gap between the armature (basically the permanent magnet) and the yoke. By superimposing a signal magnetic flux (generated by a coil whose dimensions are not so critical) the force in the air gap, between the yoke and the armature, will vary accordingly. This force can be used to generate vibrations in the transducer.

The B-71 transducer has a plastic housing with a 1.75 $cm^2$ circular attachment surface toward the head, as illustrated in FIG. 1. With a steel-spring headband, the transducer is pressed with a total force of approximately 5-6 Newton against the mastoid area behind the ear. Internally, as briefly pointed out above, the transducer consist of an armature, a yoke, and a small but essential air gap which disrupts the magnetic flux path. The magnetic flux is composed of the static flux generated by the permanent magnet and the dynamic flux generated by the current in two coils. The total weight of the B-71 transducer is 19.9 g.

Some drawbacks of the currently available variable reluctance type transducers can be pointed out. The first drawback is related to the intrinsic design and number of components involved in the design of this type of bone conduction transducers, as shown in FIG. 1. It is well know by audiologists the problems involved with this type of bone-conduction vibrators and the continuous necessity of constant recalibration of this type of actuators due to accidental dropping or simply loss of calibration during normal use. During the calibration process, screws have to be re-adjusted to obtain the expected frequency response from the transducer.

A second drawback is related to the poor frequency response of this type of actuators which in the midrange frequencies and above 4 kHz deteriorates sharply. FIG. 2 provides the frequency response for the B-71 transducer when driven under constant input amplitude for all the frequencies considered. Specifically, in FIG. 2 the amplitude of the input sinusoidal waveform was taken as 100 mV. As it can be seen, the frequency response of the B-71 actuator is very poor over the frequency range considered (200 Hz to 10 kHz) and becomes drastically low above 4 kHz. This situation has limited the bone conduction devices in the market to operate only up to 4 kHz. Ideally, a Bone Oscillator device with a flat frequency response (not more than ±5 dB) up to 4 kHz and if possible, above 4 kHz would be required.

This poor frequency response of the current state-of-the art technology has forced the current hearing threshold testing field standards to be adapted to this situation and the limitation in the state of the art of this technology. Table 1 shows the current ANSI S3.43 (1992) standard requirements for bone conduction transducers. Improvements in the 10 existing bone-conduction transducer technology will significantly benefit the possibility of considering a more realistic standard for bone conduction hearing threshold testing.

TABLE 1

ANSI S3.43 Standard
Bone Conduction Oscillator ANSI S3.43 (1992)

| | HL Setting | RMS Force Levels (dB re: 1 Dn) |
|---|---|---|
| 250 Hz | 25 dB | 72.0 |
| 500 Hz | 40 dB | 78.0 |
| 750 Hz | 40 dB | 68.5 |
| 1000 Hz | 40 dB | 62.5 |
| 1500 Hz | 40 dB | 56.5 |
| 2000 Hz | 40 dB | 51.0 |
| 3000 Hz | 40 dB | 50.0 |
| 4000 Hz | 40 dB | 55.5 |

A third drawback of the currently available type of bone-conduction oscillators is the necessity of being operated by an amplifier (so called audiometer) that needs to be specifically calibrated so that the bone-conduction oscillator provides the expected output performance. In the calibration process, the audiometer output voltage is adjusted for each frequency step required: 250 Hz, 500 Hz, 750 Hz, 1000 Hz, 1500 Hz, 2000 Hz, 3000 Hz and 4000 Hz. For each of these specific frequencies, the audiometer is tuned so that the bone conduction oscillator will provide the output force value required by the ANSI standard. This is of course not only time consuming but extremely limiting if the bone conduction device is expected to be used in a different frequency point from those calibrated. Further, it is not possible to use this type of transducers to perform a test involving a continuous frequency sweeping.

Another drawback of conventional bone conduction hearing devices is the use of a magnetic transducer, which creates electromagnetic interference (EMI). This EMI interferes with surrounding medical or radio frequency devices.

Thus, there has been a long-standing problem inherent in the construction and function of conventional bone conduction transducers used in hearing aids and for auditory testing. Typically, these devices have been restricted in the usable frequency range, particularly above 4000 Hz and they have been limited in the amplitude with which sound can be presented to the skull. Bone conduction transducers have relied on electro-mechanical components to propagate vibrations. In every day use, it has been repeatedly observed that such transducers do not operate in a linear manner. As a result, individual audiometers must be calibrated to the idiosyncratic properties of the bone conduction transducer to be used with that system. A further problem arises when the old style transducers are used on a daily basis. When dropped, the transducers frequently break or alter their output characteristics.

The previous drawbacks show the necessity of improving the existing state of the art on bone conduction transducers. Therefore there exists a necessity to provide an actuator with the correct physical size, and with a desired frequency range from 100 to 8000 Hz, linear operation across the relevant range, significant increases in power levels and in a rugged package.

SUMMARY OF THE INVENTION

With the aforementioned technological limitations in mind, it is an object of the present invention to provide a bone conduction hearing aid device which is very simple in terms of number of components and which overcomes the deficiencies and problems indicated for the currently available bone conduction hearing aid devices.

A more specific object of the present invention is to provide a hearing aid device that can be used in the hearing threshold testing field in which the frequency response of the transducer offers a wider linear response region compared to currently available bone conduction hearing aid devices.

Another object of the present invention is to provide a completely non-magnetic transducer which uses piezoelectric devices thus, eliminating the possibility of electromagnetic interferences with other surrounding medical or radio frequency devices.

These objects are accomplished by the present invention in which a piezoelectric type bone conduction transducer using a flextensional type actuator is placed in the tip of a specifically designed housing and is energized to generate mechanical vibrations. This transducer shape is adapted to be positioned against the skin over the skull of the hearing impaired person, preferably over the mastoid area of the temporal bone of the skull behind the ear of the patient, for transmission of mechanical vibrations generated by the piezoelectric actuator placed in the contact area between the transducer and the mastoid (see FIG. 3).

Piezoelectric and electrostrictive materials (generally called "electroactive" devices herein) develop an electric field when placed under stress or strain. The electric field developed by a piezoelectric or electrostrictive material is a function of the applied force and displacement causing the mechanical stress or strain. Conversely, electroactive devices undergo dimensional changes in an applied electric field. The dimensional change (i.e., expansion or contraction) of an electroactive element is a function of the applied electric field. Electroactive devices are commonly used as drivers, or "actuators" due to their propensity to deform under such electric fields. These electroactive devices when used as transducers or actuators also have varying capacities to generate an electric field in response to a deformation caused by an applied force. In such cases they behave as electrical actuators.

Electroactive devices include direct and indirect mode actuators, which typically make use of a change in the dimensions of the material to achieve a displacement, but in the present invention are preferably used as electromechanical actuators. Direct mode actuators typically include a piezoelectric or electrostrictive ceramic plate (or stack of plates) sandwiched between a pair of electrodes formed on its major surfaces. The devices generally have a sufficiently large piezoelectric and/or electrostrictive coefficient to produce the desired strain in the ceramic plate. However, direct mode actuators suffer from the disadvantage of only being able to achieve a very small displacement (strain), which is, at best, only a few tenths of a percent. Conversely, direct mode actuator-actuators require application of a high amount of force to piezoelectrically generate a pulsed momentary electrical signal of sufficient magnitude to activate a latching relay.

Indirect mode actuators are known to exhibit greater displacement and strain than is achievable with direct mode actuators by achieving strain amplification via external structures. An example of an indirect mode actuator is a flextensional transducer or actuator such as THUNDER, manufactured by Face International Corporation in Norfolk, Va. Flextensional transducers are composite structures composed of a piezoelectric ceramic element and a metallic shell, stressed plastic, fiberglass, or similar structures. The actuator movement of conventional flextensional devices commonly occurs as a result of expansion in the piezoelectric material which mechanically couples to an amplified contraction of the device in the transverse direction. In operation, they can exhibit several orders of magnitude greater strain and displacement than can be produced by direct mode actuators.

The magnitude of achievable deflection (transverse bending) of indirect mode actuators can be increased by constructing them either as "unimorph" or "bimorph" flextensional actuators. A typical unimorph is a concave structure composed of a single piezoelectric element externally bonded to a flexible metal foil, and which results in axial buckling (deflection normal to the plane of the electroactive element) when electrically energized. Common unimorphs can exhibit transverse bending as high as 10%, i.e., a deflection normal to the plane of the element equal to 10% of the length of the actuator. A conventional bimorph device includes an intermediate flexible metal foil sandwiched between two piezoelectric elements. Electrodes are bonded to each of the major surfaces of the ceramic elements and the metal foil is bonded to the inner two electrodes. Bimorphs exhibit more displacement than comparable unimorphs because under the applied voltage, one ceramic element will contract while the other expands. Bimorphs can exhibit transverse bending of up to 20% of the Bimorph length.

For certain applications, asymmetrically stress biased electroactive devices have been proposed in order to increase the transverse bending of the electroactive actuator, and therefore increase the electrical output in the electroactive material. In such devices, (which include, for example, "Rainbow" actuators (as disclosed in U.S. Pat. No. 5,471,721), and other flextensional actuators) the asymmetric stress biasing produces a curved structure, typically having two major surfaces, one of which is concave and the other which is convex.

Thus, various constructions of flextensional piezoelectric and ferroelectric actuators may be used including: indirect mode actuators (such as "moonies" and, CYMBAL); bending actuators (such as unimorph, bimorph, multimorph or monomorph devices); prestressed actuators (such as "THUNDER" and rainbow" actuators as disclosed in U.S. Pat. No. 5,471,721); and multilayer actuators such as stacked actuators; and polymer piezofilms such as PVDF. Many other electromechanical devices exist and are contemplated to function similarly to power a transceiver circuit in the invention.

The electroactive actuator preferably comprises a prestressed unimorph device called "THUNDER", which has improved displacement and load capabilities, as disclosed in U.S. Pat. No. 5,632,841. THUNDER (which is an acronym for THin layer composite UNimorph ferroelectric Driver and sEnsoR), is a unimorph flextenstional actuator in which a pre-stress layer is bonded to a thin piezoelectric ceramic wafer at high temperature. During the cooling down of the composite structure, asymmetrical stress biases the ceramic wafer due to the difference in thermal contraction rates of the pre-stress layer and the ceramic layer. A THUNDER element comprises a piezoelectric ceramic layer bonded with an adhesive (preferably an imide) to a metal (preferably stainless steel) substrate. The substrate, ceramic and adhesive are heated until the adhesive melts and they are subsequently cooled. During cooling as the adhesive solidifies the adhesive and substrate thermally contracts more than the ceramic, which compressively stresses the ceramic. Using a single substrate, or two substrates with differing thermal and mechanical characteristics, the actuator assumes its normally arcuate shape. The transducer or electroactive actuator may also be normally flat rather than arcuate, by applying equal amounts of prestress to each side of the piezoelectric element, as dictated by the thermal and mechanical characteristics of the substrates bonded to each face of the piezo-element.

Each THUNDER element is constructed with an electroactive member preferably comprising a piezoelectric ceramic layer of PZT which is electroplated on its two opposing faces. A pre-stress layer, preferably comprising spring steel, stainless steel, beryllium alloy, aluminum or other flexible substrate (such as metal, fiberglass, carbon fiber, KEVLAR™, composites or plastic), is adhered to the electroplated surface on one side of the ceramic layer by a first adhesive layer. In the simplest embodiment, the adhesive layer acts as a prestress layer. The first adhesive layer is preferably LaRC™-SI material, as developed by NASA-Langley Research Center and disclosed in U.S. Pat. No. 5,639,850. A second adhesive layer, also preferably comprising LaRC-SI material, is adhered to the opposite side of the ceramic layer. During manufacture of the THUNDER element the ceramic layer, the adhesive layer (s) and the pre-stress layer are simultaneously heated to a temperature above the melting point of the adhesive material. In practice the various layers composing the THUNDER element (namely the ceramic layer, the adhesive layers and the pre-stress layer) are typically placed inside of an autoclave, heated platen press or a convection oven as a composite structure, and slowly heated under pressure by convection until all the layers of the structure reach a temperature which is above the melting point of the adhesive material but below the Curie temperature of the ceramic layer. Because the composite structure is typically convectively heated at a slow rate, all of the layers tend to be at approximately the same temperature. In any event, because an adhesive layer is typically located between two other layers (i.e. between the ceramic layer and the pre-stress layer), the ceramic layer and the pre-stress layer are usually very close to the same temperature and are at least as hot as the adhesive layers during the heating step of the process. The THUNDER element is then allowed to cool.

During the cooling step of the process (i.e. after the adhesive layers have re-solidified) the ceramic layer becomes compressively stressed by the adhesive layers and pre-stress layer due to the higher coefficient of thermal contraction of the materials of the adhesive layers and the pre-stress layer than for the material of the ceramic layer. Also, due to the greater thermal contraction of the laminate materials (e.g. the first pre-stress layer and the first adhesive layer) on one side of the ceramic layer relative to the thermal contraction of the laminate material(s) (e.g. the second adhesive layer) on the other side of the ceramic layer, the ceramic layer deforms in an arcuate shape having a normally convex face and a normally concave face.

One or more additional pre-stressing layer(s) may be similarly adhered to either or both sides of the ceramic layer in order, for example, to increase the stress in the ceramic layer or to strengthen the THUNDER element. In a preferred embodiment of the invention, a second prestress layer is placed on the concave face of the THUNDER element having the second adhesive layer and is similarly heated and cooled. Preferably the second prestress layer comprises a layer of conductive metal. More preferably the second prestress layer comprises a thin foil (relatively thinner than the first prestress layer) comprising aluminum or other conductive metal. During the cooling step of the process (i.e. after the adhesive layers have re-solidified) the ceramic layer similarly becomes compressively stressed by the adhesive layers and pre-stress layers due to the higher coefficient of thermal contraction of the materials of the adhesive layers and the pre-stress layers than for the material of the ceramic layer. Also, due to the greater thermal contraction of the laminate materials (e.g. the first pre-stress layer and the first adhesive layer) on one side of the ceramic layer relative to the thermal contraction of the laminate material(s) (e.g. the second adhesive layer and the second prestress layer) on the other side of the ceramic layer, the ceramic layer deforms into an arcuate shape having a normally convex face and a normally concave face.

Alternately, the second prestress layer may comprise the same material as is used in the first prestress layer, or a material with substantially the same mechanical strain characteristics. Using two prestress layers having similar mechanical strain characteristics ensures that, upon cooling, the thermal contraction of the laminate materials (e.g. the first pre-stress layer and the first adhesive layer) on one side of the ceramic layer is substantially equal to the thermal contraction of the laminate materials (e.g. the second adhesive layer and the second prestress layer) on the other side of the ceramic layer, and the ceramic layer and the transducer remain substantially flat, but still under a compressive stress.

Alternatively, the substrate comprising a separate prestress layer may be eliminated and the adhesive layers alone or in conjunction may apply the prestress to the ceramic layer. Alternatively, only the prestress layer(s) and the adhesive layer(s) may be heated and bonded to a ceramic layer, while the ceramic layer is at a lower temperature, in order to induce greater compressive stress into the ceramic layer when cooling the transducer.

Yet another alternate THUNDER actuator element includes a composite piezoelectric ceramic layer that comprises multiple thin layers of PZT which are bonded to each other or cofired together. In the mechanically bonded embodiment, two layers or more (not shown) may be used in this composite structure. Each layer comprises a thin layer of piezoelectric material, with a thickness preferably on the order of about 1 mil. Each thin layer is electroplated on each major face respectively. The individual layers are then bonded to each other with an adhesive layer, using an adhesive such as LaRC-SI. Alternatively, and most preferably, the thin layers may be bonded to each other by cofiring the thin sheets of piezoelectric material together. As few as two layers, but preferably at least four thin sheets of piezoelectric material may be bonded/cofired together. The composite piezoelectric ceramic layer may then be bonded to prestress layer (s) with the adhesive layer(s), and heated and cooled as described above to make a modified THUNDER transducer. By having multiple thinner layers of piezoelectric material in a modified transducer, the composite ceramic layer generates a lower voltage and higher current as compared to the high voltage and low current generated by a THUNDER transducer having only a single thicker ceramic layer. Additionally, a second prestress layer may be used comprise the same material as is used in the first prestress layer, or a material with substantially the same mechanical strain characteristics as described above, so that the composite piezoelectric ceramic layer and the transducer remain substantially flat, but still under a compressive stress.

Yet another alternate THUNDER actuator element includes another composite piezoelectric ceramic layer that comprises multiple thin layers of PZT which are cofired together. In the cofired embodiment, two or more layers, and preferably at least four layers, are used in this composite structure. Each layer comprises a thin layer of piezoelectric material, with a thickness preferably on the order of about 1 mil, which are manufactured using thin tape casting for example. Each thin layer placed adjacent each other with electrode material between each successive layer. The electrode material may include metallizations, screen printed, electro-deposited, sputtered, and/or vapor deposited conductive materials. The individual layers and internal electrodes are then bonded to each other by cofiring the composite multi-layer ceramic element. The individual layers are then poled in alternating directions in the thickness direction. This is accomplished by connecting high voltage electrical connections to the electrodes, wherein positive connections are connected to alternate electrodes, and ground connections are connected to the remaining internal electrodes. This provides an alternating up-down polarization of the layers in the thickness direction. This allows all the individual ceramic layers to be connected in parallel. The composite piezoelectric ceramic layer may then be bonded to prestress layer(s) with the adhesive layer(s), and heated and cooled as described above to make a modified THUNDER transducer.

By having multiple thinner layers of piezoelectric material in a modified transducer, the composite ceramic layer generates a lower voltage and higher current as compared to the high voltage and low current generated by a THUNDER transducer having only a single thicker ceramic layer. This is because with multiple thin paralleled layers the output capacitance is increased, which decreases the output impedance, which provides better impedance matching with the electronic circuitry connected to the THUNDER element. Also, since the individual layers of the composite element are thinner, the output voltage can be reduced to reach a voltage which is closer to the operating voltage of the electronic circuitry (in a range of 3.3V-10.0V) which provides less waste in the regulation of the voltage and better matching to the desired operating voltages of the circuit. Thus the multilayer element (bonded or cofired) improves impedance matching with the connected electronic circuitry and improves the efficiency of the mechanical to electrical conversion of the element.

A flexible insulator may be used to coat the convex face of the transducer. This insulative coating helps prevent unintentional discharge of the piezoelectric element through inadvertent contact with another conductor, liquid or human contact. The coating also makes the ceramic element more durable and resistant to cracking or damage from impact. Since LaRC-SI is a dielectric, the adhesive layer on the convex face of the transducer may act as the insulative layer. Alternately, the insulative layer may comprise a plastic, TEFLON, KAPTON or other durable coating.

Electrical energy may be recovered from or introduced to the actuator element by a pair of electrical wires. Each electrical wire is attached at one end to opposite sides of the actuator element. The wires may be connected directly to the electroplated faces of the ceramic layer, or they may alternatively be connected to the pre-stress layer(s). The wires are connected using, for example, conductive adhesive, or solder, but most preferably a conductive tape, such as a copper foil tape adhesively placed on the faces of he electroactive actuator element, thus avoiding the soldering or gluing of the conductor. As discussed above, the pre-stress layer is preferably adhered to the ceramic layer by LaRC-SI material, which is a dielectric. When the wires are connected to the pre-stress layer(s), it is desirable to roughen a face of the pre-stress layer, so that the pre-stress layer intermittently penetrates the respective adhesive layers, and makes electrical contact with the respective electroplated faces of the ceramic layer. Alternatively, the Larc-SI adhesive layer may have a conductive material, such as Nickel or aluminum particles, used as a filler in the adhesive and to maintain electrical contact between the prestress layer and the electroplated faces of the ceramic layer(s).

Prestressed flextensional transducers are desirable due to their durability and their relatively large displacement, and concomitant relatively high voltage that such transducers are capable of developing when deflected by an external force. The present invention however may be practiced with any electroactive element having the properties and characteristics herein described, i.e., the ability to generate a voltage in response to a deformation of the device. For example, the invention may be practiced using magnetostrictive or ferroelectric devices. The transducers also need not be normally arcuate, but may also include transducers that are normally flat, and may further include stacked piezoelectric elements.

Different types of flextensional actuators have been evaluated during the development of this solution including unimorphs, bimorphs, RAINBOW, Thunder®, moonies, cymbals and other types of so-called flextensional piezoelectric actuators. These actuators can be potentially used in the implementation of this patent and it should be understood that the disclosures of this patent are immediately extended to all of these different actuators technologies alternatives.

Among all these actuators, after an evaluation of the drawbacks and benefits of the various technologies, the preferred and primarily deployed technology in the suggested different embodiments of this invention is the high displacement inherently pre-stressed actuators of the Thunder®-type. Thunder actuators are developed by Face International Corporation, Norfolk, Va. These actuators allow very large displacements along with appreciable force generation and mechanical vibrations can be generated in a way similar to the ones described for electromagnetic devices. A particular advantage of these actuators compared to other similar piezo-actuator technologies such as unimorphs, bimorphs, RAINBOW, etc, is their rugged and durable configuration. This is a critical requirement for this application since the piezoelectric element is expected to be pressed firmly against the head surface with an external static stress imparted by the headband.

As envisioned and practically developed, the flextensional actuator is fixed along its periphery and vibrates in way very similar to a circular membrane. One unique particularity of the proposed solution compared to other bone-conduction hearing-aid devices is that the piezoelectric actuator is not using any additional means to transfer the vibrations to the patient's head and is directly in contact with the patient's skin. Prior art transducers, as the described in FIG. 1 for the B-71 bone-vibrator, produce vibrations which are transmitted to an external housing and then to the patient's head. In the embodiments discussed in this patent, the piezoelectric actuator has a direct contact with the head.

In the proposed solution, the housing has been designed to fulfill three main functions. Firstly, it acts as a support for the piezoelectric actuator, so that the actuator can vibrate in a way similar to a membrane. Secondly, it provides the required mass (inertial force) and support for the piezoelectric actuator to transfer the vibrations to the patient's head. Lastly, it can be used as a means to partially stress the piezoelectric actuator in the radial direction. By applying an additional prestress to the actuator, it has been demonstrated that its performance can be improved.

In the preferred embodiments, the design of the piezoelectric actuators includes a completely new isolated design with a specific tap design for the actuator and its electrodes. The isolation of the transducer is required to avoid electrical contact between the actuator and the patient's head contact area. The preferable solution for electrical isolation without high transmission losses is to use a thin dielectric layer of Kapton isolating material completely covering the transducer.

The specific design of the tap also bypasses the use of wires to connect the actuator. The use of wires on the surface in contact with the patient's head will be a source of discomfort and will partially disrupt the mechanical contact between the actuator tip and the head. In order to solve this issue, two taps with completely flat and thin metallic extensions are designed that can be extended out of the transducer up to the connector eliminating the use of wires. This approach provides a very compact solution and eliminates soldering wires on the actuators, which is always a potential impairment factor for actuator depolarization through high temperature solder. Furthermore, this solution provides a compact means of manufacturing the actuator having a prior connection leads, thus eliminating one manufacturing (wire soldering) step in the process.

BRIEF DESCRIPTION OF THE DRAWINGS

Some of the salient features and advantages of the current inventions have been briefly stated and others will appear in the detailed description which follows, when taken into consideration with the accompanying drawings, in which:

FIG. 4*a* is an exploded view of the piezoelectric Bone Conduction device of present invention showing its the main components.

FIG. 8*a* is a top perspective view of the device showing the upper housing and cylindrical and annular surfaces for retention of the piezoelectric actuator along its periphery.

FIG. 8*b* is a plan view of the device showing the four points of epoxy placed at four points along the periphery of the piezoelectric actuator at approximately 90° angle difference.

FIG. 9 is a schematic of the experimental setup used in the frequency response measurement of the device of current invention.

FIG. 10 is a schematic of the experimental setup used in the preceision sound level measurement of the device of current invention.

FIGS. 11*a* and 11*b* are Force vs. frequency plots using Thunders in brass housing (31 g) at 2 and 10 Vrms input.

FIG. 12 is a Force vs. frequency plot using a Thunder TH-8C6S in brass housing (31 g) at various input voltages. The annexed plot is in logarithmic scale for frequency to depict the response at low frequency.

FIGS. 13*a* and 13*b* are Force vs. frequency plots using Thunders in brass housing (51 g) at 2 and 10 Vrms input.

FIG. 14 is a Force vs. frequency plot using Thunder 8C6S in brass housing (51 g) at different input voltages. The annexed plot is in logarithmic scale for frequency to depict the response at low frequency.

FIGS. 15*a* and 15*b* are Force vs. frequency plots using Thunders in aluminum housing (21 g) at 2 and 10 Vrms input.

FIG. 16 is a Force vs. frequency plot using Thunder TH-10C10S in brass housing (51 g) at different input voltages. The annexed plot is in logarithmic scale for frequency to depict the response at low frequency.

DETAILED DESCRIPTION OF THE INVENTION

In the description that follows, the present invention will be described in reference to preferred embodiments. The present invention, however, is not limited to any specific embodiment. Therefore, the elucidation of the embodiments that follow is for the purpose of illustration for this particular family of technology and is not a limitation.

The bone-conduction hearing-aid device described in this patent has been designed to target the hearing threshold testing field. Additionally, the use of this novel technology is extended and covers other application areas where the ability of sending hearing signals through bone conduction may benefit patients having hearing deficiencies. Among those applications areas, the developed technology can be adapted in hearing aids, phone systems, music devices, MP3 players, cell-phones, underwater communication gear and other similar devices.

Figure 4A:
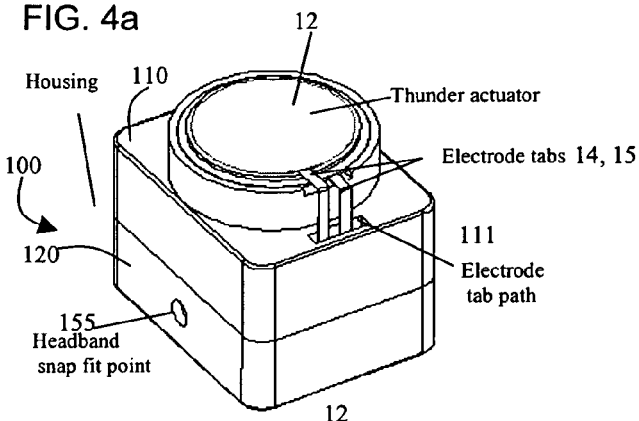
FIG. 4*a* is a perspective view of the piezoelectric Bone Conduction device of present invention as well as an exploded view of its the main components.
Figure 4B:
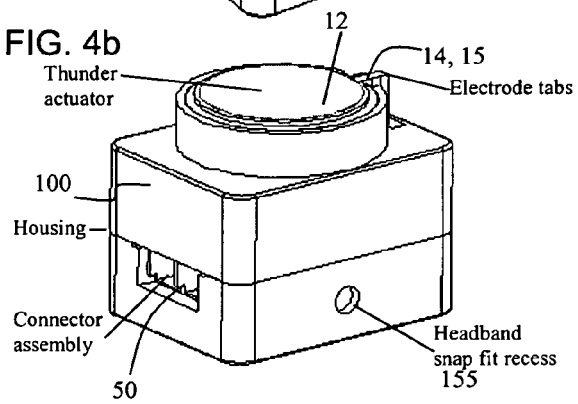
FIG. 4*b* is another perspective view of the piezoelectric Bone Conduction device of present invention.
Figure 4C:
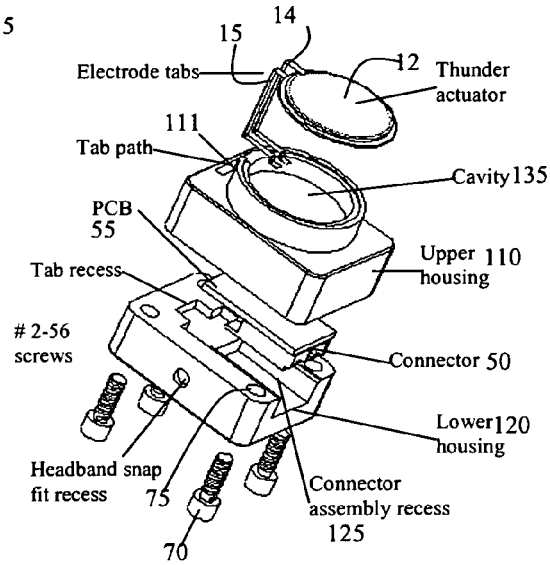

In the preferred embodiment for the hearing threshold testing field, the bone conduction transducer 1 has been designed in agreement with the ANSI S3.42 (1992) Standard. The actuator consists of three main parts including i) the housing 100 (which includes an upper housing 110 and a lower housing 120), ii) the piezoelectric-flextensional actuator 12, and iii) the connector 50. A view of the completed transducer 1 with its individual components is given in FIG. 4.

The actuator 12 is the component that generates the mechanical vibrations and hence, the force that is transmitted to the patient through bone conduction. In order to meet ANSI Standard specifications, the actuator 12 has been designed with a circular geometry with a nominal area of 175±25 $mm^2$. This area becomes, at the same time, the contact area between the transducer 12 and the hearing patient's skin surface which is one of the ANSI S3.42 (1992) Standard requirements.

Figure 5A:
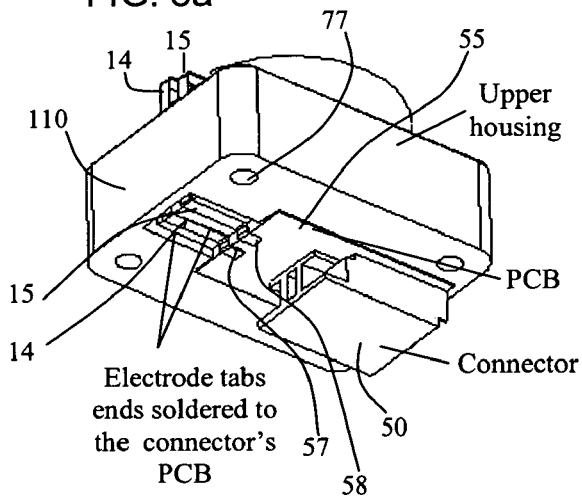
FIG. 5*a* is a perspective view of the upper housing with the actuator shown in position on the upper housing and showing the connector assembly for connection with the lower housing recess.
Figure 5B:
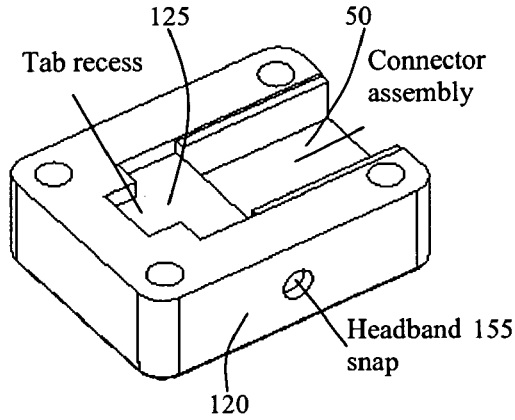
FIG. 5*b* is a perspective view of the lower housing and showing the recess for connection to the upper housing connector assembly.

The piezoelectric actuator 12 has a set of electrode tabs 14, 15 which are conductive strips having first and second ends. The tabs 14, 15 are straight after the manufacturing process and are bent in the shape depicted in FIGS. 4*a-c* downwardly to pass through the tab path 111 of the upper housing 110 and are electrically connected to the connector assembly 50. Tab 14 is electrically connected between the conductive superstrate 24 of the actuator 12 and a first electric terminal 57 of the connector assembly 50, and the second tab 15 is electrically connected between the electrode layer 25 of the actuator 12 and a second electric terminal 58 of the connector assembly 50. The connector assembly 50 comprises a printed circuit board (PCB) 55 and a power connection 51 for the power supply (and frequency input) to the bone conduction device. The connector 51 is rigidly soldered to the PCB 55, preferably at four solder points. The connector assembly 50 sits in the connector assembly recess 125 of the lower housing 120 which has tight tolerances to exactly house the connector assembly 50. The electrode tabs 14, 15 ends are soldered to the PCB 55 as shown in FIG. 5.

The upper housing 110 is made from an electrically non-conductive material as a precaution to avoid short circuit conditions since it carries the actuator 12 which requires electrical energy input. The upper housing 110 also has a shallow recess 115 with precise tolerances to house the PCB 55 of the connector assembly 50. The abutment of the PCB 55 to the recess 115 of the upper housing 110 towards the power input 59 side of the device provides a stop for the connector assembly 50 when the power input cable is plugged in and out. The bottom housing 120 is made from a heavier material, preferably a metal as in the illustrated embodiments, to provide the required mass for good low frequency response of the bone conduction device of the present invention. The lower housing 120 is attached to the upper housing 110 with four # 2-56 counter bore screws 70 which pass through holes 75 in each corner of the lower housing 120 and tap into tapped screw holes 77 in the upper housing 110.

Figure 6A:
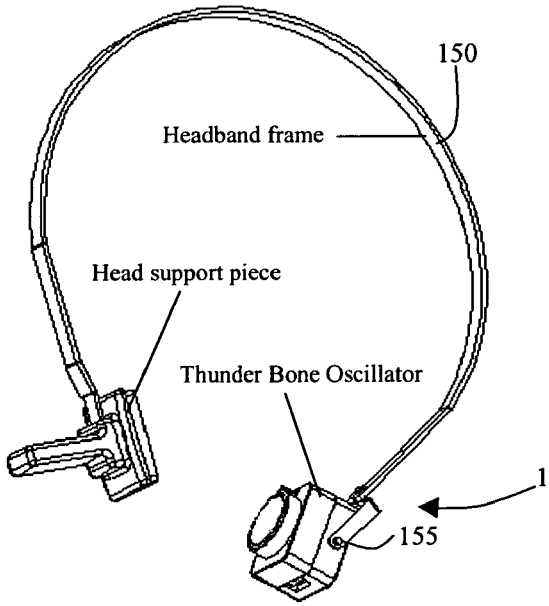
FIG. 6*a* is a perspective view of the headband accessory required to hold the piezoelectric Bone Conduction device in the human mastoid area.
Figure 6B:
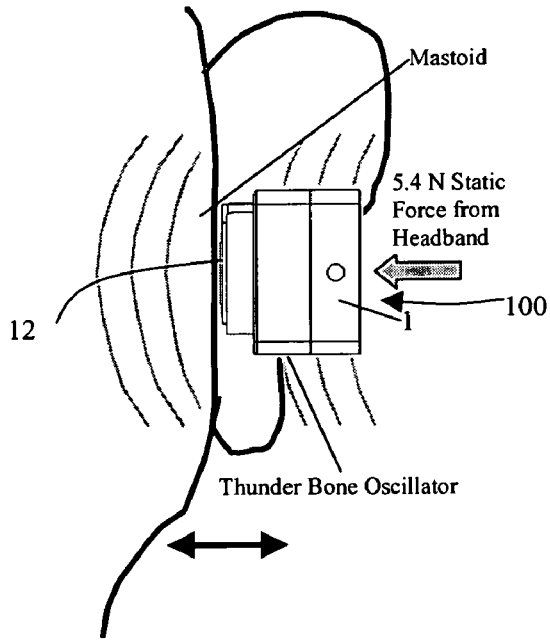
FIG. 6*b* is an elevation view showing the basic action of the device in the human mastoid area in presence of the static force imparted by the headband.

In the hearing threshold testing field, the transducer 12 is fixed against a patient's head with a steel spring set or head band 150 as in FIG. 6. This head band 130 provides an external force of approximately 5 N between the bone transducer 1 and the patient's head, as specified by ANSI Standards. The headband 150 connects to snap-fit points 155 in the sides of the lower housing 120 of the transducer 1.

In the preferred embodiments, the piezoelectric actuator 12 has been manufactured using THUNDER® actuator technology, although other flextensional piezoelectric actuators could also be considered. This patent covers all of these alternatives, including unimorphs, bimorphs, cymbals, RAINBOW, and other similar families of flextensional-type piezoelectric actuators.

THUNDER technology is based on thin layered piezoelectric-metal composite technology originally developed at NASA. The bonding material used is the high performance bonding material LaRC SI which has a complex curing cycle. This class of actuators 12 is unique in their ability to produce large displacements and considerable force at the same time. Rugged construction and durability are some of the properties of these actuators 12. Due to the specific use of Thunder technology, the preferred embodiments will be also referred in this patent as Thunder Bone Transducers. Face International Corporation is the worldwide manufacture for THUNDER piezoelectric actuator 12 technology.

Piezoelectric and electrostrictive materials (generally called "electroactive" devices herein) develop an electric field when placed under stress or strain. The electric field developed by a piezoelectric or electrostrictive material is a function of the applied force and displacement causing the mechanical stress or strain. Conversely, electroactive devices undergo dimensional changes in an applied electric field. The dimensional change (i.e., expansion or contraction) of an electroactive element is a function of the applied electric field. Electroactive devices are commonly used as drivers, or "actuators" due to their propensity to deform under such electric fields.

Electroactive devices include direct and indirect mode actuators, which typically make use of a change in the dimensions of the material to achieve a displacement, but in the present invention are preferably used as electromechanical generators. Direct mode actuators typically include a piezoelectric or electrostrictive ceramic plate (or stack of plates) sandwiched between a pair of electrodes formed on its major surfaces. The devices generally have a sufficiently large piezoelectric and/or electrostrictive coefficient to produce the desired strain in the ceramic plate. However, direct mode actuators suffer from the disadvantage of only being able to achieve a very small displacement (strain), which is, at best, only a few tenths of a percent. Conversely, direct mode generator-actuators require application of a high amount of force to piezoelectrically generate a pulsed momentary electrical signal of sufficient magnitude to activate a latching relay.

Indirect mode actuators are known to exhibit greater displacement and strain than is achievable with direct mode actuators by achieving strain amplification via external structures. An example of an indirect mode actuator is a flextensional transducer. Flextensional transducers are composite structures composed of a piezoelectric ceramic element and a metallic shell, stressed plastic, fiberglass, or similar structures. The actuator movement of conventional flextensional devices commonly occurs as a result of expansion in the piezoelectric material which mechanically couples to an amplified contraction of the device in the transverse direction. In operation, they can exhibit several orders of magnitude greater strain and displacement than can be produced by direct mode actuators.

The magnitude of achievable deflection (transverse bending) of indirect mode actuators can be increased by constructing them either as "unimorph" or "bimorph" flextensional actuators. A typical unimorph is a concave structure composed of a single piezoelectric element externally bonded to a flexible metal foil, and which results in axial buckling (deflection normal to the plane of the electroactive element) when electrically energized. Common unimorphs can exhibit transverse bending as high as 10%, i.e., a deflection normal to the plane of the element equal to 10% of the length of the actuator. A conventional bimorph device includes an intermediate flexible metal foil sandwiched between two piezoelectric elements. Electrodes are bonded to each of the major surfaces of the ceramic elements and the metal foil is bonded to the inner two electrodes. Bimorphs exhibit more displacement than comparable unimorphs because under the applied voltage, one ceramic element will contract while the other expands. Bimorphs can exhibit transverse bending of up to 20% of the Bimorph length.

For certain applications, asymmetrically stress biased electroactive devices have been proposed in order to increase the transverse bending of the electroactive generator, and therefore increase the electrical output in the electroactive material. In such devices, (which include, for example, "Rainbow" actuators (as disclosed in U.S. Pat. No. 5,471,721), and other flextensional actuators) the asymmetric stress biasing produces a curved structure, typically having two major surfaces, one of which is concave and the other which is convex.

Thus, various constructions of flextensional piezoelectric and ferroelectric generators may be used including: indirect mode actuators (such as "moonies" and, CYMBAL); bending actuators (such as unimorph, bimorph, multimorph or monomorph devices); prestressed actuators (such as "THUNDER" and rainbow" actuators as disclosed in U.S. Pat. No. 5,471,721); and multilayer actuators such as stacked actuators; and polymer piezofilms such as PVDF. Many other electromechanical devices exist and are contemplated to function similarly to power a transceiver circuit in the invention.

Figure 7A:
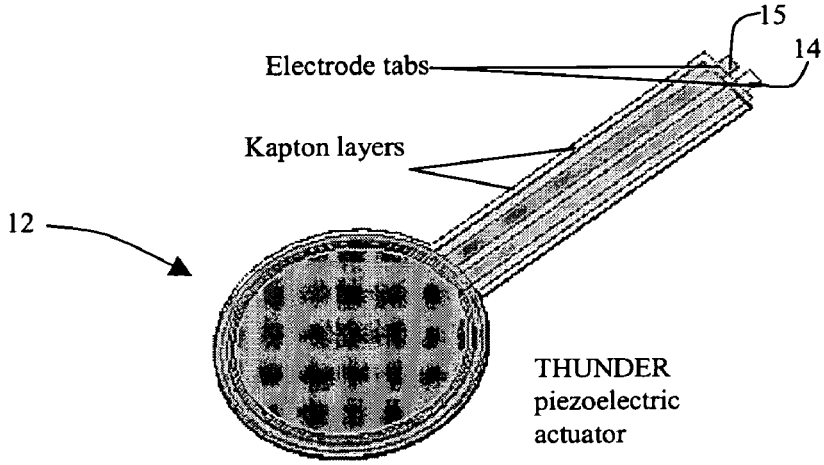
FIG. 7*a* is a perspective view of the electrically isolated piezoelectric actuator employed in the present Bone Conduction device showing the two electrode tabs.
Figure 7B:
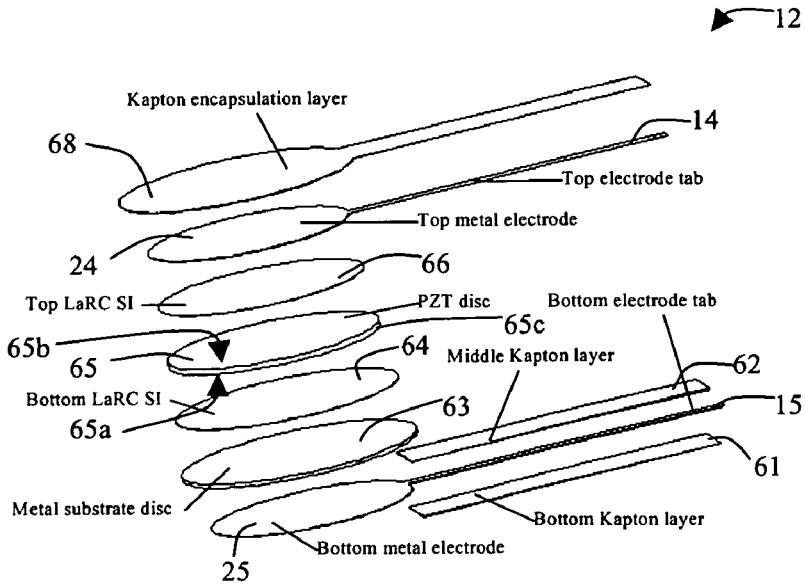
FIG. 7*b* is an exploded view of the various components that make up the composite actuator of FIG. 7*a*.
Figure 17:
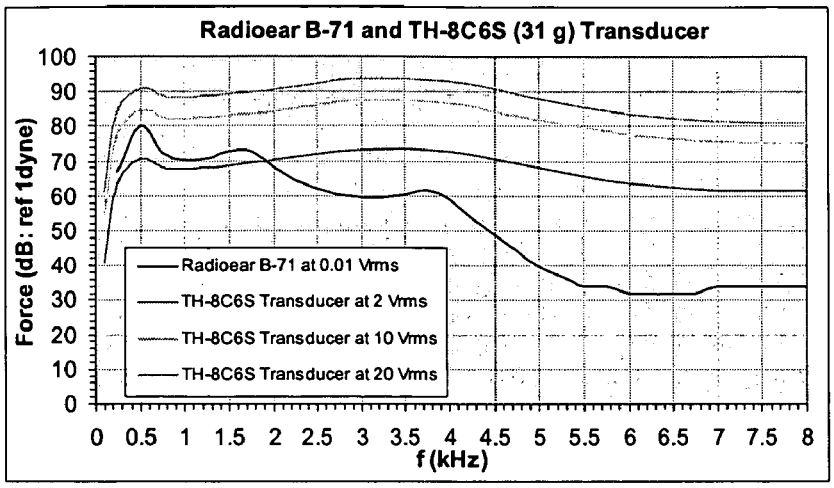
FIG. 17 is a comparison of Force vs. frequency characteristics comparison between Radioear B-71 and TH-8C6S Bone Conduction transducer at 2 and 10 Vrms.

Referring to FIG. 7*a-b*: The electroactive generator preferably comprises a prestressed unimorph device called "THUNDER", which has improved displacement and load capabilities, as disclosed in U.S. Pat. No. 5,632,841. THUNDER (which is an acronym for THin layer composite UNimorph ferroelectric Driver and sEnsoR), is a unimorph device in which a pre-stress layer is bonded to a thin piezoelectric ceramic wafer at high temperature. During the cooling down of the composite structure, asymmetrical stress biases the ceramic wafer due to the difference in thermal contraction rates of the pre-stress layer and the ceramic layer. A THUNDER element comprises a piezoelectric ceramic layer bonded with an adhesive (preferably an imide) to a metal (preferably stainless steel) substrate. The substrate, ceramic and adhesive are heated until the adhesive melts and they are subsequently cooled. During cooling as the adhesive solidifies the adhesive and substrate thermally contracts more than the ceramic, which compressively stresses the ceramic. Using a single substrate, or two substrates with differing thermal and mechanical characteristics, the actuator assumes its normally arcuate shape. The transducer or electroactive generator may also be normally flat rather than arcuate, by applying equal amounts of prestress to each side of the piezoelectric element, as dictated by the thermal and mechanical characteristics of the substrates bonded to each face of the piezo-element.

The THUNDER element 12 is as a composite structure, the construction of which is illustrated in FIGS. 7*a-b*. Each THUNDER element 12 is constructed with an electroactive member preferably comprising a piezoelectric ceramic layer 65 of PZT which is electroplated on its two opposing faces 65*a*, 65*b*. A pre-stress layer 63, preferably comprising spring steel, stainless steel, beryllium alloy, aluminum or other flexible substrate (such as metal, fiberglass, carbon fiber, KEVLAR™, composites or plastic), is adhered to the electroplated 65*a* surface on one side of the ceramic layer 65 by a first adhesive layer 64. In the simplest embodiment, the adhesive layer 64 acts as a prestress layer. The first adhesive layer 64 is preferably LaRC™-SI material, as developed by NASA-Langley Research Center and disclosed in U.S. Pat. No. 5,639,850. A second adhesive layer 66, also preferably comprising LaRC-SI material, is adhered to the opposite side of the ceramic layer 65*b*. During manufacture of the THUNDER element 12 the ceramic layer 65, the adhesive layer(s) 64 and 66 and the pre-stress layer 63 are simultaneously heated to a temperature above the melting point of the adhesive material. In practice the various layers composing the THUNDER element (namely the ceramic layer 65, the adhesive layers 64, 66 and the pre-stress layer 63) are typically placed inside of an autoclave, heated platen press or a convection oven as a composite structure, and slowly heated under pressure by convection until all the layers of the structure reach a temperature which is above the melting point of the adhesive 66 material but below the Curie temperature of the ceramic layer 65. Because the composite structure is typically convectively heated at a slow rate, all of the layers tend to be at approximately the same temperature. In any event, because an adhesive layer 64 is typically located between two other layers (i.e. between the ceramic layer 65 and the pre-stress layer 63), the ceramic layer 65 and the pre-stress layer 63 are usually very close to the same temperature and are at least as hot as the adhesive layers 64, 66 during the heating step of the process. The THUNDER element 12 is then allowed to cool.

During the cooling step of the process (i.e. after the adhesive layers 64, 66 have re-solidified) the ceramic layer 65 becomes compressively stressed by the adhesive layers 64, 66 and pre-stress layer 63 due to the higher coefficient of thermal contraction of the materials of the adhesive layers 64, 66 and the pre-stress layer 63 than for the material of the ceramic layer 65. Also, due to the greater thermal contraction of the laminate materials (e.g. the first pre-stress layer 63 and the first adhesive layer 64) on one side of the ceramic layer 65 relative to the thermal contraction of the laminate material(s) (e.g. the second adhesive layer 66) on the other side of the ceramic layer 65, the ceramic layer deforms in an arcuate shape having a normally convex face and a normally concave face.

Referring again to FIGS. 7*a-b*: One or more additional pre-stressing layer(s) may be similarly adhered to either or both sides of the ceramic layer 65 in order, for example, to increase the stress in the ceramic layer 65 or to strengthen the THUNDER element 12. In a preferred embodiment of the invention, a second prestress layer 24 is the upper electrode 24 which is placed on the top face 65*b* of the ceramic element 65 having the second adhesive layer 66 and is similarly heated and cooled. Preferably the second prestress layer 24 comprises a layer of conductive metal. More preferably the second prestress layer 24 comprises a thin foil (relatively thinner than the first prestress layer 63) comprising aluminum or other conductive metal. During the cooling step of the process (i.e. after the adhesive layers 64 and 66 have re-solidified) the ceramic layer 65 similarly becomes compressively stressed by the adhesive layers 64 and 66 and pre-stress layers 63 and 24 due to the higher coefficient of thermal contraction of the materials of the adhesive layers 64 and 66 and the pre-stress layers 63 and 24 than for the material of the ceramic layer 65. Also, due to the greater thermal contraction of the laminate materials (e.g. the first pre-stress layer 63 and the first adhesive layer 64) on one side of the ceramic layer 65 relative to the thermal contraction of the laminate material(s) (e.g. the second adhesive layer 66 and the second prestress layer 24) on the other side of the ceramic layer 65, the ceramic layer 65 deforms into an arcuate shape having a normally convex face and a normally concave face.

The Thunder actuator 12 in FIG. 7 is specially designed for the illustrated embodiments. The actuator 12 comprises multiple layers which are core build up layers as well as layers for proper electrical insulation. The bottom metal electrode 25 is a circular electrode that is connected to and/or unitary with the bottom electrode tab 15, and are preferably one single entity. The top metal electrode 24 is also a circular electrode that is connected to and/or unitary with the top electrode tab 14, and also are preferably one single entity. Each of the tabs 14, 15 comprises a thin strip of conductive material. The bottom Kapton layer 61 is attached to the bottom surface of the bottom electrode tab 15 with high performance liquid LaRC SI adhesive. The bottom metal electrode 15 is attached to the bottom surface of the metal substrate disc 63 with conductive epoxy. The middle Kapton layer 62 is then attached to the top surface of the bottom electrode tab 15 with liquid LaRC SI. The metal substrate disc 63 is bonded, using a disc of high performance LaRC SI adhesive, to the bottom face 65*a* of the electroactive layer 65, which preferably comprises a disc of piezoelectric material, such as PZT. The top face 65*b* of the electroactive layer 65 is bonded to the top metal electrode 24 using high performance liquid LaRC SI adhesive. The top most layer is the Kapton encapsulation layer 68 which covers the entire top area of the actuator 12, including the top electrode 24 and top electrode tab 14. The Kapton encapsulation layer 68 provides the electrical insulation between the patient's head and the bone conduction device. The complete composite Thunder device is manufactured after curing through a specific temperature and pressure profiles in an autoclave.

One of the key issues in the manufacturing of this type of oscillator is the fixation of the Thunder actuator 12 to the upper housing 110. Different techniques have been considered and experimentally evaluated. The maximum displacement for Thunder actuators 12 is achieved at the dome height which is the highest point on the surface of the actuator 12 (in absence of voltage input) from the rest surface on which it is placed in simply supported mounting. The displacement at the dome height point is obtained due to the sweeping motion of the actuator in which the circular edge 12*a* moves towards or away from the center and the actuator 12 gets more curved or flatter respectively. Hence, it is important for the actuator 12 to be mounted with just the right amount of strong but compliant bonding along the periphery 12*a* so that the sweeping motion is not heavily hampered and appreciable vibration amplitudes are generated.

Initial experiments were performed with a simple tape of dielectric Kapton maintaining the actuator 12 in the right position. This solution provided a good prototyping solution that permitted quick evaluation of different Thunder actuator 12 designs in the same housing 100. Although this solution is useful for the prototyping phase, a different type of fixing solution is required for the end-device.

For the last version of the product, two different fixing techniques were tested. The first technique involves fixing of the actuator 12 along its entire peripheral edge 12*a* with epoxy. However, as was initially expected, this technique significantly limited the vibration generated by the actuator 12. Thus, a "four" point fixing system was employed as in FIG. 8. Basically, four small blobs of epoxy 80 are dispensed along the circumference 12*a* of the metal substrate disc 63 at an angular interval of about 90° from each other. This technique allows appreciable vibration amplitudes, improves the oscillator response and retains the Thunder in the upper housing 110 very well. The upper housing 110 retains the actuator 12 within an essentially cylindrical retainer 130 on the top surface 110*a* of the upper housing 110. The retainer 130 is a cylinder having an internal cavity 136 and a top surface 130. On this top surface 130*a* is a circular and/or C-shaped mounting ring 132 which has an inner cylindrical surface 132*a* and a top annular surface 132*b*. The epoxy 80 drops are placed such that they are spread over a small area of the metal substrate disc 63, the inner cylindrical surface 132*a* and the top annular surface 132*b*. These three contact areas for the epoxy 80 ensure adequate bonding surface. The epoxy drops are small enough not to come in contact with the mastoid area when the tip of the Thunder actuator 12 is in contact with the skin during operation. The mounting ring 132 may have a gap therein, i.e. be C-shaped, to provide a tab outlet 135 for the actuator tabs 14, 15 to pass though and down to the tab path 111 through the upper housing 110.

DESCRIPTION OF SPECIFIC EMBODIMENTS

In order to provide some examples of the value of the technology compared to the prior state of the art, several embodiments are described and their operational characteristics are given. Different types of housings 100 were prepared with different types of materials (steel, brass, aluminum and acrylic) and different masses. The external dimensions (length, width and height) of the housing 100 were kept constant in all the housings. This was considered important to facilitate the measuring conditions. Particularly, the thickness of the actuators 12 is also the same as the conventional bone conduction oscillator B-71, which also allow an easy comparison of the performance with the same set-up. Center holes of different dimensions were made in the housings 100 to meet the specific mass target. Table 2 summarizes the different housings considered including the conventional Radioear B-71.

TABLE 2

Different housings considered

| Material | Brass | Brass | Aluminum | Acrylic | Radioear B71 |
|---|---|---|---|---|---|
| Mass | 51 g | 31 g | 21 g | 9 g | 21 g |

For each of the different housings 100 considered, different Thunder actuators 12 were assembled to them and the actuators 12 were tested. In total, five different models of Thunder actuators 12 (ceramic and stainless steel substrate combinations) were manufactured and tested with the different housings 100. Table 3 summarizes the different combinations of Thunder actuators 12 manufactured for these tests.

TABLE 3

Dimensions of Thunder composite materials.

| PZT thickness (milli-inches) | Stainless Steel thickness (milli-inches) | PZT Dia. (inches) | Stainless Steel Dia. (inches) | Thunder Designation |
|---|---|---|---|---|
| 15 | 6 | 0.55 | 0.61 | TH-15C6S |
| 10 | 10 | 0.55 | 0.61 | TH-10C10S |
| 7 | 10 | 0.55 | 0.61 | TH-7C10S |
| 10 | 6 | 0.55 | 0.61 | TH-10C6S |
| 8 | 6 | 0.55 | 0.61 | TH-8C6S |

In order to use the same actuator 12 in different housings 100, the actuators 12 were initially attached to the housing temporarily with a 0.25" wide strip of Kapton tape externally across the diameter of the Thunder element 12. After screening the different housing/actuator possibilities, some of the actuators 12 were completely fixed to the housing.

The experimental setup used during the transducer testing is illustrated in FIG. 9. The transducers 1 were driven at constant input voltage from a function generator 200, i.e., an audiometer having a range of frequencies to electrically input into the connector 50. The selected input voltages were 2 Vrms, 10 Vrms and 20 Vrms. The frequency of the input voltage was controlled by a function generator 200. The input voltage and input current to the transducer 1 were recorded with a four channel digital oscilloscope. The output from the artificial mastoid, i.e. from the force transducer 1 embedded in the body of the artificial mastoid, was directly connected to another similar oscilloscope. This output voltage from the artificial mastoid is proportional to the force introduced by the bone conduction transducer 1. The actual force in Newtons was calculated from the ratio of output voltage from the artificial mastoid to the sensitivity of the force transducer inside the artificial mastoid. The sensitivity value for this artificial mastoid was 145 mV/N as given in its calibration chart. The force values obtained in Newtons this way were converted into dB taking the logarithmic function and the reference of 1 dyne ($10^{-5}$ N). The experimental setup of FIG. 9 was automatically controlled using LabView data acquisition software. The values of the force were confirmed by using the Bruel & Kjaer Precision Sound Level Meter (FIG. 10).

The frequency response for the considered embodiments of newly developed Thunder bone vibrators 1 are provided below. The frequency response is compared with the B-71 Radioear bone vibrator. The test results are provided for each of the housings 100 suggested (31 g and 51 g brass housing and 21 g aluminum housing) with the various combinations of Thunder actuators 12 coupled in them. Finally, these Thunder Bone Conduction transducer 1 performance results are then compared among themselves as well as with the Radioear B-71 electromagnetic vibrator.

First Embodiment

Housing 1 (31 g brass housing). FIG. 11 show the force variation with frequency at input voltage levels of 2 and 10 $V_{rms}$ respectively. 8C6S_epoxy signifies that the Thunder 1 was attached to the brass housing 100 at four diametrically opposite points (90° apart) with epoxy 80. As expected, the increase in the applied voltage shows a distinctive increase in the force level at each frequency. The actuators 12 show a well-defined response in the range of 250 Hz to over 8 kHz (only plotted up to 8 kHz). The force level at 100 Hz was low and the reading was not accurate at that frequency point. The response of the Radioear B-71 at 0.1 Vrms is also shown in each of the figures to emphasize on the dramatic performance improvement with Thunder technology.

For all the voltage levels, it is seen that the various bone vibration transducers 1 made with different Thunder actuators 12 thickness show very similar response. However, the transducer TH-8C6S shows a slightly better performance at low frequencies (below 500 Hz) compared to the transducers 1 with other Thunder actuators. Therefore, a further test with this Thunder device attached to the brass housing 100 with four points of epoxy 80 was performed. The results are seen to be even slightly better compared to the condition when the Thunder 1 was just taped to the housing 100. Table 4 summarizes the performance of TH-8C6S Bone Conduction transducer 1 when used with 31 g brass housing 100. The ANSI S3.43 (1992) specifications and the values desired by HCRI are also depicted in the table. FIG. 12 shows the different force response curves for the TH-8C6S transducer for the applied voltage levels.

TABLE 4

TH-8C6S Bone Conduction transducer with 31 g brass housing.

| Freq | ANSI S3.43 | Force (dB: ref 1 dyne) Measured at Face at voltage inputs of | | | HCRI |
|---|---|---|---|---|---|
| [Hz] | (1992) | 2 $V_{rms}$ | 10 $V_{rms}$ | 20 $V_{rms}$ | Specs. |
| 100 | — | 41.0 | 54.5 | 61.2 | — |
| 250 | 72.0 | 63.2 | 77.5 | 84.2 | 80.0 |
| 500 | 78.0 | 70.7 | 84.8 | 91.1 | 85.0 |

TABLE 4-continued

TH-8C6S Bone Conduction transducer with 31 g brass housing.

| Freq | ANSI S3.43 | Force (dB: ref 1 dyne) Measured at Face at voltage inputs of | | | HCRI |
|---|---|---|---|---|---|
| [Hz] | (1992) | 2 $V_{rms}$ | 10 $V_{rms}$ | 20 $V_{rms}$ | Specs. |
| 750 | 68.5 | 68.2 | 82.5 | 88.8 | 85.0 |
| 1000 | 62.5 | 67.9 | 82.2 | 88.5 | 85.0 |
| 1500 | 56.5 | 68.7 | 83.0 | 89.3 | 85.0 |
| 2000 | 51.0 | 70.1 | 84.4 | 90.7 | 85.0 |
| 3000 | 50.0 | 73.3 | 87.6 | 93.8 | 85.0 |
| 4000 | 55.5 | 72.8 | 86.8 | 92.9 | 85.0 |
| 5000 | — | 68.0 | 82.0 | 87.9 | — |
| 6000 | — | 63.8 | 77.7 | 83.6 | — |
| 7000 | — | 61.6 | 75.6 | 81.4 | — |
| 8000 | — | 61.6 | 75.4 | 81.0 | — |

Second Embodiment

Housing 2 (51 g brass housing). FIG. 13 shows the force vs. frequency behavior of the Thunder Bone Conduction transducers 1 with 51 g brass housing at 2 and 10 Vrms input voltage level. The response is very similar to the ones with 31 g housing except that the low frequency response is improved. However, the dip in the range 5-8 kHz is larger which is not desirable. Further, the overall fluctuation in the force response is seen to be the highest in the TH-8C6S transducer which was considered to be best when used with 31 g mass.

Table 5 shows the performance of TH-8C6S Bone Conduction transducer 1 when used with 51 g brass housing 100. The ANSI S3.43 (1992) specifications and the values desired by HCRI are also depicted in the table. FIG. 9 shows the different force response curves for the TH-8C6S transducer for the applied voltage levels.

TABLE 5

TH-8C6S Bone Conduction transducer with 51 g brass housing.

| Frequency | ANSI S3.43 | Force (dB: ref 1 dyne) Measured at Face at voltage inputs of | | | HCRI |
|---|---|---|---|---|---|
| (Hz) | (1992) | 2 $V_{rms}$ | 10 $V_{rms}$ | 20 $V_{rms}$ | Specs. |
| 100 | — | 45.7 | 54.9 | 61.3 | — |
| 250 | 72.0 | 70.0 | 78.1 | 84.6 | 80.0 |
| 500 | 78.0 | 68.0 | 79.3 | 85.6 | 85.0 |
| 750 | 68.5 | 67.2 | 78.2 | 84.5 | 85.0 |
| 1000 | 62.5 | 67.3 | 78.2 | 84.6 | 85.0 |
| 1500 | 56.5 | 68.3 | 79.2 | 85.6 | 85.0 |
| 2000 | 51.0 | 69.8 | 80.6 | 87.0 | 85.0 |
| 3000 | 50.0 | 72.9 | 83.3 | 89.6 | 85.0 |
| 4000 | 55.5 | 71.5 | 83.3 | 89.6 | 85.0 |
| 5000 | — | 65.5 | 79.4 | 85.5 | — |
| 6000 | — | 57.5 | 73.0 | 79.0 | — |
| 7000 | — | 51.3 | 71.2 | 77.4 | — |
| 8000 | — | 59.2 | 74.7 | 80.7 | — |

Third Embodiment

Housing 3 (21 g aluminum housing). The test results with the two brass housings showed that increasing the mass of the system improved the frequency response of the transducer in the lower frequency range as a second order system would do.

The interest then shifted towards making the system comparable in mass to the Radioear B-71 and see if there would be a drastic loss of performance in the lower frequency region. FIG. 15 shows the performance of a selected few Thunders when used with the 21 g aluminum housing. The Radioear B-71 performance at an input voltage of 0.1 $V_{rms}$ included in the plots.

FIG. 16 shows the frequency response of TH-10C10S Bone Conduction transducer at 2, 10 and 20 Vrms with the 21 g aluminum housing obtained from the data of Table 6.

TABLE 6

TH-10C10S Bone Conduction transducer with 21 g aluminum housing.

| Frequency (Hz) | Force (dB: ref 1 dyne) ANSI S3.43 (1992) | Measured at Face at voltage inputs of 2 $V_{rms}$ | 10 $V_{rms}$ | 20 $V_{rms}$ | HCRI Specs. |
|---|---|---|---|---|---|
| 100 | — | 35.0 | 44.2 | 51.0 | — |
| 250 | 72.0 | 51.1 | 65.1 | 71.6 | 80.0 |
| 500 | 78.0 | 68.8 | 82.9 | 89.4 | 85.0 |
| 750 | 68.5 | 69.7 | 83.8 | 90.1 | 85.0 |
| 1000 | 62.5 | 68.1 | 82.2 | 88.6 | 85.0 |
| 1500 | 56.5 | 67.8 | 81.9 | 88.3 | 85.0 |
| 2000 | 51.0 | 68.4 | 82.5 | 89.0 | 85.0 |
| 3000 | 50.0 | 70.1 | 84.3 | 90.6 | 85.0 |
| 4000 | 55.5 | 70.6 | 84.7 | 91.0 | 85.0 |
| 5000 | — | 70.2 | 84.3 | 90.5 | — |
| 6000 | — | 66.6 | 80.5 | 86.6 | — |
| 7000 | — | 63.1 | 77.0 | 83.0 | — |
| 8000 | — | 63.6 | 77.5 | 83.8 | — |

Performance Comparison with Prior Art Bone Conduction Transducer

The prior art Radioear B-71 Bone Conduction Transducer was also tested using LabView. The output from the force transducer inside the artificial mastoid was disconnected from the audiometer (Bruel & Kjaer Sound Level Meter) and directly connected to an oscilloscope to acquire force data in terms of voltage. The input voltage to the B-71 transducer was controlled at 0.1 $V_{rms}$ since the transducer is limited to low voltage level operation due to limitations on current. FIG. 12 shows the comparison of response between the Radioear B-71 and the TH-8C6S Bone Conduction transducer when used with the 31 g housing.

Thunder Bone Conduction Transducer Acoustic Noise Reduction

One of the salient features expected in a bone conduction device 1 is that it should be as quiet as possible, i.e. minimum noise generation that is air conducted. An ideal transducer 1 would be one without any noise emission but only bone conducted vibration. The acoustic property of the material of the housing 100 as well as the physical features of the cavity 136 within the housing covered by the Thunder affect the noise generation from the transducer at high frequencies, especially above 2 kHz. If the noise intensity level is too high, the air conducted noise will overshadow the bone conducted signal giving rise to inaccuracies in hearing level experiments.

Test were performed on a few methods to reduce the air-conducted noise. An example table is given in Table 6 where tests were performed on TH-7C10S in the 51 g brass housing. The table has been divided into two parts for the same set of driving voltages and range of frequencies. One is for the case in which the bore 138 of the cavity 136 along the height of the housing 100 was unobstructed and in the other case, the hole 138 was plugged with a specific type of foam 140 available in the lab. The emitted noise from the transducer 1 was measured with a portable sound level meter by Realistic which was clamped to an appropriate fixture such that the distance between the receiver of the meter and the loading arm of the artificial mastoid was 0.25". This distance was maintained for all the other tests that were conducted to test the emitted noise intensity level. The noise levels at frequencies below 2 kHz have not been included in the following table since the noise was barely audible at those frequencies and the environmental noise had a more dominating effect. The portable sound level meter measures the sound level with respect to a reference level of 0.0002 μbar (0.1 Pa) which is the standard value taken in acoustics.

TABLE 6

TH-7C10S Bone Conduction transducer with 51 g brass housing.

| | Housing without acoustically-absorbing foam | | | | Housing after including acoustically-absorbing foam | | | |
|---|---|---|---|---|---|---|---|---|
| | 2 $V_{rms}$ | | 10 $V_{rms}$ | | 2 $V_{rms}$ | | 10 $V_{rms}$ | |
| Frequency [Hz] | Force [dB] | Acoustic Noise (dB) | Force (dB) | Noise (dB) | Force (dB) | Noise (dB) | Force (dB) | Noise (dB) |
| 100 | 44.1 | — | 58.2 | — | 44.2 | — | 58.3 | — |
| 250 | 66.7 | — | 81.1 | — | 66.9 | — | 81.2 | — |
| 500 | 69.3 | — | 83.6 | — | 68.8 | — | 83.4 | — |
| 750 | 67.9 | — | 82.2 | — | 67.6 | — | 82.1 | — |
| 1000 | 67.9 | — | 82.2 | — | 67.8 | — | 82.1 | — |
| 1500 | 68.9 | — | 83.2 | — | 68.7 | — | 83.0 | — |
| 2000 | 70.2 | 62 | 84.5 | 65 | 69.9 | 64 | 84.2 | 64 |
| 3000 | 73.1 | 65 | 87.4 | 79 | 72.8 | 64 | 87.2 | 75 |
| 4000 | 73.5 | 72 | 87.6 | 85 | 73.9 | 66 | 88.2 | 77 |
| 5000 | 70.0 | 78 | 83.8 | 92 | 69.4 | 71 | 83.6 | 84 |
| 6000 | 64.1 | 67 | 77.9 | 82 | 63.5 | 64 | 77.8 | 69 |
| 7000 | 60.6 | 65 | 74.3 | 74 | 59.8 | 64 | 73.9 | 67 |
| 8000 | 62.4 | 67 | 75.8 | 75.8 | 61.4 | 64 | 75.2 | 71 |

Figure 18:
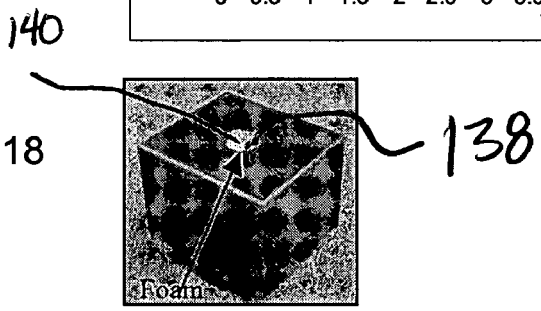
FIG. 18 is a perspective view showing noise dampening foam placed in the hole of the 51 g brass housing.
Figure 19:
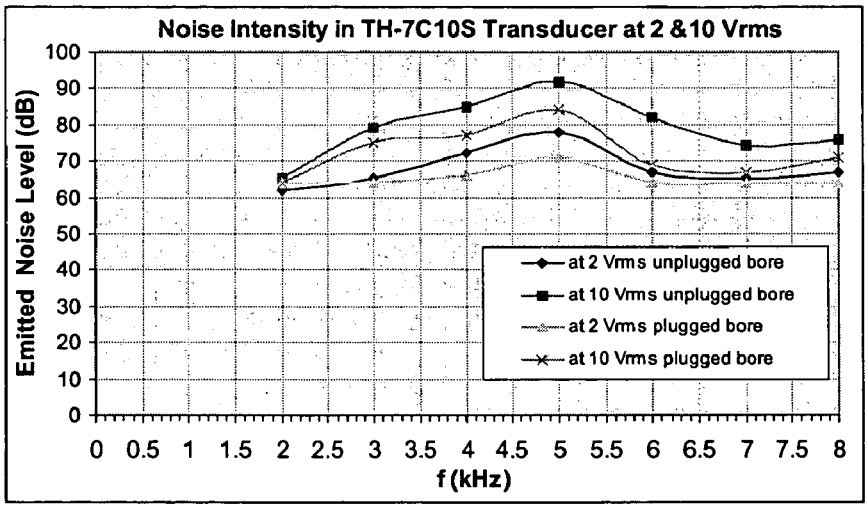
FIG. 19 is a plot of Noise intensity level measured at a distance of 0.25" from the top surface of the artificial mastoid 4930 loading arm in TH-7C10S Bone Conduction Transducer.
Figure 20:
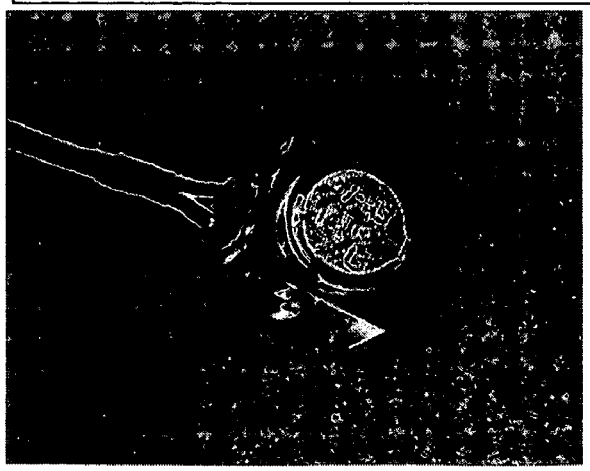
FIG. 20 is a perspective view of the Bone Conduction Hearing device of the present invention showing the transducer in an acrylic housing.

The noise intensity level emitted from the Thunder Bone Conduction transducer 1 is seen to decrease significantly with the introduction of the foam material 140 as shown in FIG. 18. This might be one of the ways to mitigate the noise level if a bore 138 is required in the housing 100 design. FIG. 19 shows the plot of emitted noise level from the transducer 1 at 2 and 10 $V_{rms}$ when the bore 138 was left unplugged and plugged with a piece of foam 140.

Figure 1A:
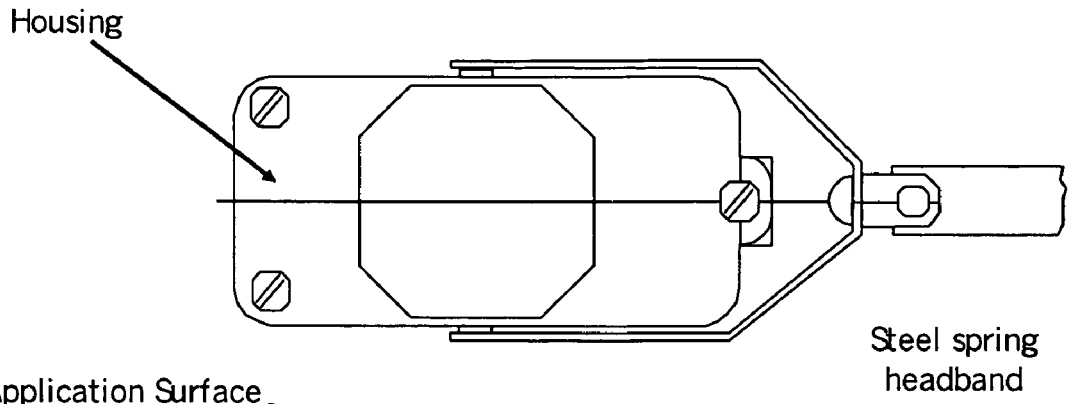
FIG. 1*a* is a plan view of a prior art electromagnetic technology based bone conduction device.
Figure 1B:
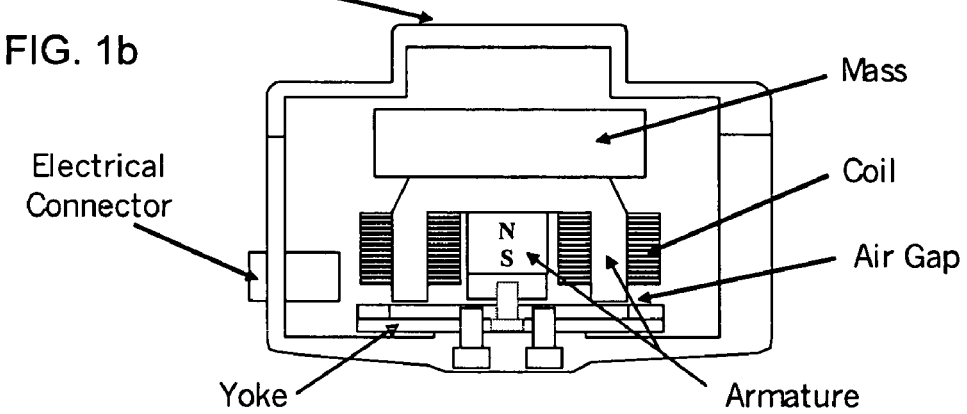
FIG. 1*b* is a cross sectional view of a prior art electromagnetic technology based bone conduction device.
Figure 2:
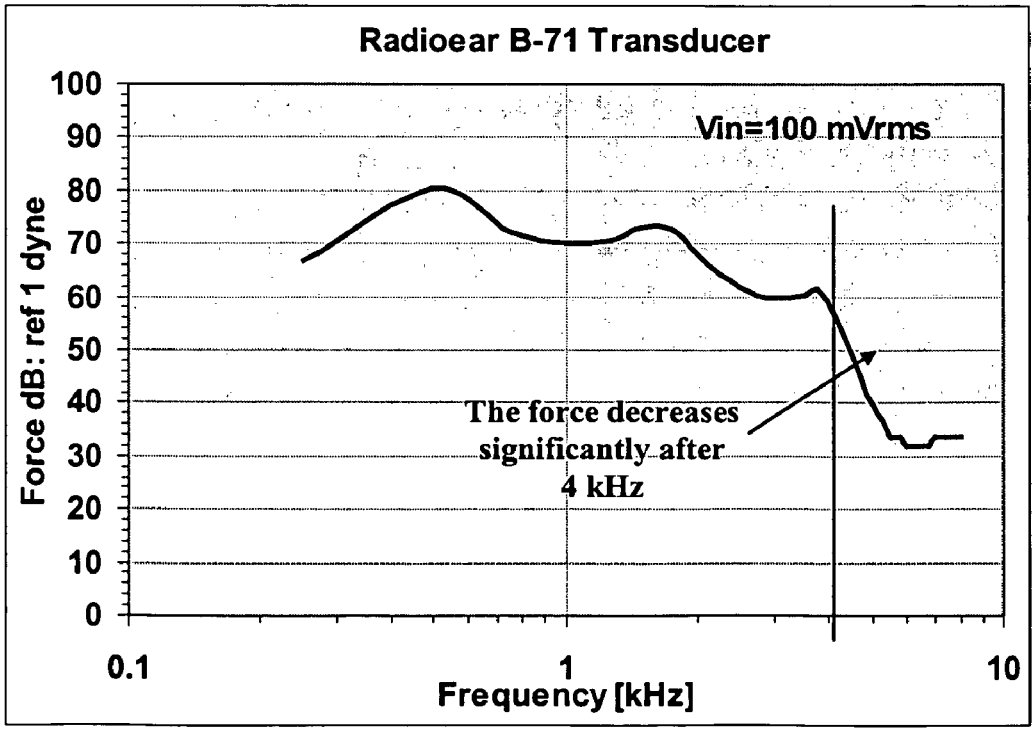
FIG. 2 is a plot of the frequency response of the B-71 Bone Conduction device depicting the highly deviating behavior in the frequency range 250-4000 Hz and a drastic drop in response beyond 4000 Hz.
Figure 3:
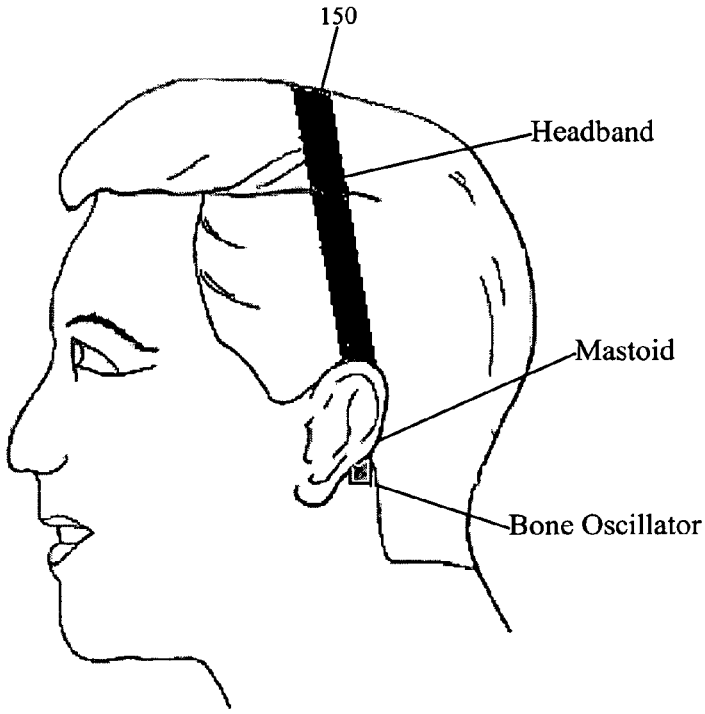
FIG. 3 is a perspective view illustrating the manner of use of the Bone Conduction device of the current invention which requires a headband to hold it in the mastoid area.

The above discussion provided a detailed description on the improvements provided by the novel technology which allow to overcome the different drawbacks pointed out for the prior art on bone conduction vibrators. Thunder Bone Oscillator 1 is simple in construction and provides and excellent flat frequency response over a wide frequency range at a periodic voltage input of constant amplitude. The flat frequency range covers not only the range specified by the ANSI S3.43 Standard (from 250 Hz up to 4 kHz, see Table 1) but is extended to higher frequencies over 10 kHz. In the different embodiments tested that will be described below in this section, the frequency response is flat within ±3 dB up to 4 kHz and does not deteriorate by more than 7 dB between 4-8 kHz. Conventional actuators such as the B-71, still in use, cannot be used beyond 4 kHz due to their drastic decrease in performance (see FIG. 2).

The new Thunder Bone Oscillator 1 has fewer components and promises high reliability from the point of component failure. Additionally, the main driving element being a piezoelectric device, electromagnetic interference problems are ruled out. The power requirement for these devices is very low due to significantly low current flowing in the actuator circuit.

We claim:

1. A bone conduction audio transducer, comprising:

a electroactive actuator;

said electroactive actuator comprising a normally flat electroactive ceramic disc bonded between a metal substrate and a conductive superstrate; and an electrode layer bonded to said metal substrate;

wherein said substrate and said superstrate exert a compressive stress on said electroactive ceramic disc;

and wherein said compressive stress on said electroactive ceramic disc deforms said normally flat disc into an arcuate domed disc;

and wherein said electroactive actuator deforms becoming more arcuate in response to a voltage being applied across said electrode layer and said conductive superstrate;

and wherein said deformation of said electroactive actuator exerts a force against a mastoid surface against which said electroactive actuator placed;

first and second electrical tabs electrically connected to said electroactive actuator;

said first electrical tab comprising a first strip of conductive material bonded at one end to said conductive superstrate;

said second electrical tab comprising a second strip of conductive material bonded at one end to said electrode layer;

an electrical connector for receiving an electrical signal having a voltage and a frequency;

said connector comprising a first electrical terminal and a second electrical terminal;

said first electrical terminal being electrically connected to a second end of said first electrical tab;

said second electrical terminal being electrically connected to a second end of said second electrical tab; and a housing for said electroactive actuator and said electrical connector;

said housing having a recess therein for retaining said electrical connector;

said housing having a cavity thereon for retaining said electroactive actuator;

wherein said force exerted by said electroactive actuator in response to said electrical signal received by said electrical connector is substantially constant in a frequency range between 250 Hertz and 8 kilohertz.

* * * * *